US008881433B2

(12) United States Patent
Hanson

(10) Patent No.: US 8,881,433 B2
(45) **Date of Patent: *Nov. 11, 2014**

(54) IMPLEMENT ATTACHING TO A FORWARD MOTION-PRODUCING MACHINE FOR ELEVATING AN EDGE ENCOUNTERING AN IMMOVABLE OBJECT

(75) Inventor: Grant Hanson, Glenwood, MN (US)

(73) Assignee: Glenridge, Inc., Glenwood, MN (US)

( * ) Notice: Subject to any disclaimer, the term of this patent is extended or adjusted under 35 U.S.C. 154(b) by 305 days.

This patent is subject to a terminal disclaimer.

(21) Appl. No.: 13/285,451

(22) Filed: Oct. 31, 2011

(65) Prior Publication Data

US 2012/0107078 A1 May 3, 2012

Related U.S. Application Data

(63) Continuation-in-part of application No. 12/085,537, filed as application No. PCT/US2006/045668 on Nov. 30, 2006, now Pat. No. 8,046,939.

(51) Int. Cl.

| | |
|---|---|
| ***E01H 5/04*** | (2006.01) |
| ***E02F 9/22*** | (2006.01) |
| ***E02F 9/20*** | (2006.01) |
| ***E02F 3/76*** | (2006.01) |
| ***E02F 3/43*** | (2006.01) |
| ***E01H 5/06*** | (2006.01) |
| ***E02F 3/34*** | (2006.01) |
| ***E02F 3/42*** | (2006.01) |
| ***E02F 3/36*** | (2006.01) |

(52) U.S. Cl.

CPC ..... *E02F 3/422* (2013.01); *E02F 9/2217* (2013.01); *E02F 9/2029* (2013.01); *E02F 9/226* (2013.01); *E02F 3/7672* (2013.01); *E02F 3/432* (2013.01); *E01H 5/063* (2013.01); *E02F 3/3405* (2013.01); *E02F 3/3604* (2013.01)

USPC ..... 37/232

(58) Field of Classification Search

CPC ..... E01H 5/04; E01H 5/066; E01H 5/098

USPC ..... 37/231, 232, 241–245, 274, 281, 266; 172/722, 810–823

See application file for complete search history.

(56) References Cited

U.S. PATENT DOCUMENTS 1,744,801 A 1/1930 Rimple et al.
1,833,859 A 11/1931 Robison et al.

(Continued)

FOREIGN PATENT DOCUMENTS

WO 91/09177 6/1991

OTHER PUBLICATIONS

Tim Wallace Snowplow Supply, Hiniker Plows, "Move More Snow Faster—Hiniker 8000 Series Convertible C-Plow", 2003.

*Primary Examiner* — Robert Pezzuto

(74) *Attorney, Agent, or Firm* — Hamre, Schumann, Mueller & Larson, P.C.

(57) ABSTRACT

An implement attaching to a vehicle and having a work assembly and a linkage assembly, the work assembly having an edge commonly used for clearing snow. The work assembly may be for example a bucket on a front end loader. The linkage assembly is formed as a non-parallelogram quadrilateral with four pivot axes. Upper and lower pivot axes attach the linkage assembly to the work assembly. When the vehicle is driven so that the edge strikes an immovable object, the linkage assembly functions so that the lower pivot axis moves in a direction toward the work assembly relative to the upper pivot axis. That is, the quadrilateral linkage assembly functions to lift the edge as a heel of the work assembly remains on the ground such that the work assembly is allowed to tilt up so the edge can ride over the immovable object.

8 Claims, 22 Drawing Sheets

(56) References Cited

U.S. PATENT DOCUMENTS

| | | | |
|---|---|---|---|
| 2,166,424 | A | 7/1939 | Coates |
| 2,629,944 | A | 2/1953 | Arps |
| 2,643,470 | A | 6/1953 | Kaeser |
| 2,697,289 | A | 12/1954 | Ernest |
| 2,700,233 | A | 1/1955 | Johnson et al. |
| 2,745,328 | A | 5/1956 | Brimhall |
| 2,756,522 | A | 7/1956 | Bomford |
| 2,862,315 | A | 12/1958 | Hilaire |
| 2,890,805 | A | 6/1959 | Pilch |
| 3,005,511 | A | 10/1961 | Riedy |
| 3,098,309 | A | 7/1963 | Koch |
| 3,151,406 | A | 10/1964 | Fryer |
| 3,231,991 | A | 2/1966 | Wandscheer et al. |
| 3,456,369 | A | 7/1969 | Leposky |
| 3,587,182 | A | 6/1971 | Hilt |
| 3,587,751 | A | 6/1971 | Schmidt, Jr. |
| 3,626,614 | A | 12/1971 | Kahlbacher |
| 3,650,054 | A | 3/1972 | Hanson |
| 3,749,269 | A | 7/1973 | Conrad |
| 3,808,714 | A | 5/1974 | Reissinger et al. |
| 3,845,577 | A | 11/1974 | Naymik |
| 3,883,965 | A | 5/1975 | Poirier |
| 4,141,257 | A | 2/1979 | Hammond et al. |
| 4,307,523 | A | 12/1981 | Reissinger et al. |
| 4,635,387 | A | 1/1987 | Häring |
| 4,704,922 | A | 11/1987 | Suketomo et al. |
| 4,773,302 | A | 9/1988 | Mizota et al. |
| 4,794,710 | A | 1/1989 | Häring |
| 4,843,744 | A | 7/1989 | Jansen |
| 4,917,565 | A | 4/1990 | Kourogi |
| 5,019,761 | A | 5/1991 | Kraft |
| 5,044,098 | A | 9/1991 | Berghefer |
| 5,136,795 | A | 8/1992 | Rosenberg |
| 5,655,318 | A | 8/1997 | Daniels |
| 5,697,172 | A | 12/1997 | Verseef |
| 5,720,122 | A | 2/1998 | McLellan |
| 5,941,921 | A | 8/1999 | Dasys et al. |
| 6,073,371 | A | 6/2000 | Goos et al. |
| 6,116,846 | A | 9/2000 | Bulkley |
| 6,263,595 | B1 | 7/2001 | Ake |
| 6,581,306 | B1 | 6/2003 | DiClementi |
| 6,640,468 | B2 | 11/2003 | Menze |
| 6,701,646 | B2 | 3/2004 | Schultz et al. |
| 6,711,837 | B2 | 3/2004 | Bloxdorf et al. |
| 6,757,994 | B1 | 7/2004 | Hendron |
| 6,792,704 | B2 | 9/2004 | Johnson |

IMPLEMENT ATTACHING TO A FORWARD MOTION-PRODUCING MACHINE FOR ELEVATING AN EDGE ENCOUNTERING AN IMMOVABLE OBJECT

This application is a Continuation in Part of patent application Ser. No. 12/085,537 filed on May 27, 2008, now issued U.S. Pat. No. 8,046,939, which is a U.S. National Stage Application of International Application No. PCT/US2006/045668, filed on Nov. 30, 2006, which is a non-provisional of U.S. patent application Ser. No. 11/291,259, filed on Dec. 1, 2005, These applications are hereby incorporated by reference in their entirety.

FIELD OF THE INVENTION

The invention is directed generally to an implement attaching to a propulsion machine and, more particularly, to a work assembly having an edge and a heel and a linkage assembly which is the sole attachment between the work assembly and the propulsion machine which functions to rapidly elevate the edge when it strikes a fixed obstruction.

BACKGROUND

Commercial snow plows, front end loaders and snow blowers have a long history of use in removing snow with a blade or edge from streets and highways. Over the past several decades the use of snow plows on light and medium duty trucks has become commonplace. Snow plows work well for clearing snow from roadways, particularly in open places and in areas where yearly snowfall totals are such that the snow can be readily pushed off the roadway. In addition, snow blowers are widely used by people in clearing snow from their yards and sidewalks. There are other uses where a front end loader, a tractor or some other propulsion machine pulls or pushes a tool having a working edge.

One of the issues related to the use of snow clearing machines is that a great amount of stress is imparted to the structural components when plowing in areas such as those prone to frost heaving where manhole covers, and other relatively fixed objects, are struck by a moving scraping edge. Not only do such encounters with immovable objects greatly shorten the life of these snow clearing machines, but they are also quite jarring to the machine operator and pose an enhanced risk of injury to the machine operator as well as others in the vicinity of the machines that are in operation.

Several devices have been developed for use with snow clearing machines, particularly, snow plows, whereby either the whole plow blade, or just a portion of it, pivots back up to about 90 degrees upon encountering a fixed object in the road (see for example U.S. Pat. Nos. 6,701,646 and 5,697,172, respectively). Such devices, while effective for some of the snow plow blades, are not compatible with some other snow clearing machines. For example, due to the different geometry of a loader bucket, the bucket's longitudinal depth combined with the required rear pivotal connections for lifting and dumping prevent such a pivoting back since such pivoting generally requires a pivot point on an angle greater than 45 degrees up from the leading edge. Also, since such buckets typically have a leading edge attached to the horizontal structure of the bucket bottom, the tilting back solutions are impractical because this would require tilting the whole bucket backwards by around 180 degrees. Consequently, there is a need for a device which allows the working edge to ride up over fixed objects upon impacting them, which thereby reduces the wear and tear particularly on snow clearing machines while also enhancing the safety of the machine operator and the public at large.

BRIEF SUMMARY

The invention is directed to a work implement attaching to a forward motion-producing machine. In this context, "forward motion-producing machine" means a structure comprising a body, wheels, and a means for self propulsion. Examples of the type of machines to which the invention may be most appropriately attached include all-terrain vehicles (ATVs), farm tractors, skid loaders, pickup trucks and snow blowers. It is understood that the work implement may be used for snow or other accumulations, such as, for example, manure. The inventive implement as attached to such motion-producing machine provides for the edge to rise up and pass over fixed objects, rather than tilt backwards as in the prior art.

The work assembly of the implement has an edge and a heel. Additionally, a linkage assembly is attachable between the work assembly and the motion-producing machine. When the edge of the work assembly strikes an immovable object, the linkage assembly moves from a first to a second configuration. When the linkage assembly is in the first configuration, the edge and the heel are both resting on ground. When the linkage assembly is in the second configuration, the heel is on the ground and the edge is elevated to allow the edge to ride up and over the immovable object.

The implement is versatile in that it may be attached in front of the forward motion-producing machine or behind the forward motion-producing machine.

BRIEF DESCRIPTION OF THE DRAWINGS

FIG. 1A shows the bucket riding over a flat surface; FIG. 1B shows the bucket riding up over a fixed object which it initially struck.

DETAILED DESCRIPTION

The disclosure relates to an implement for attaching a work assembly having an edge and a heel to a forward motion-producing machine, or a vehicle and includes a linkage assembly attachable to the vehicle. The linkage assembly has first and second pivot axes pivotally connecting with the work assembly. The first pivot axis is beneath the second pivot axis. The linkage assembly has first and second configurations: the first configuration includes the first axis located in a first position horizontally relative to the second axis, the second configuration includes the first axis located in a second position horizontally relative to the second axis. The second position is horizontally separated in a direction toward the work assembly relative to the first position. When the scraping edge of the work assembly strikes an immovable object, the linkage assembly moves from the first to the second configuration. When the linkage assembly is in the first configuration, the edge and the heel are both resting on ground. When the linkage assembly is in the second configuration, the heel is on the ground and the edge is elevated to allow the edge to ride over the immovable object.

Figure 1A:
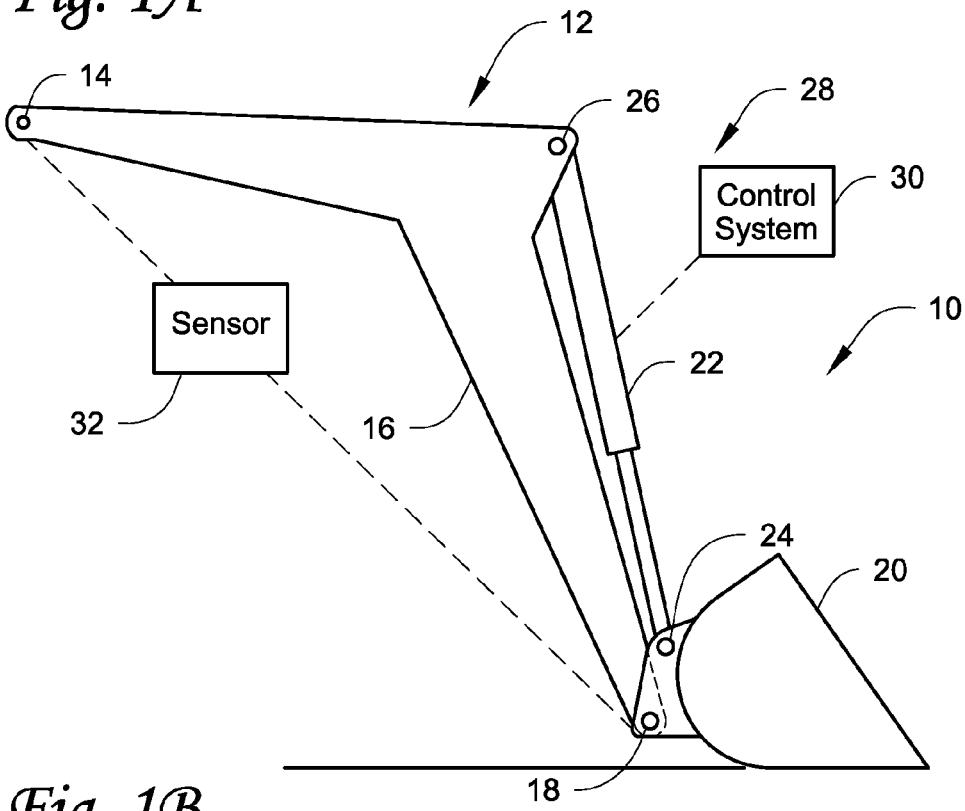
FIGS. 1A and 1B illustrate schematically in side view an embodiment of the present invention, including a sensor and bucket tilt control system.
Figure 1B:
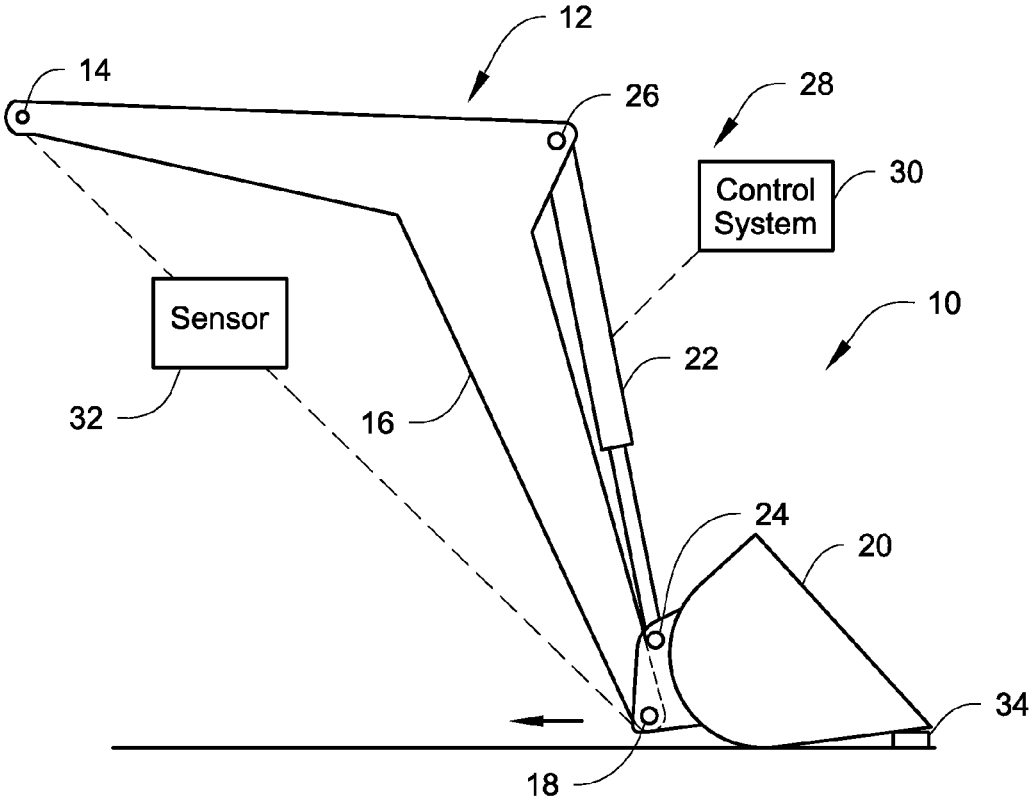
Figure 2:
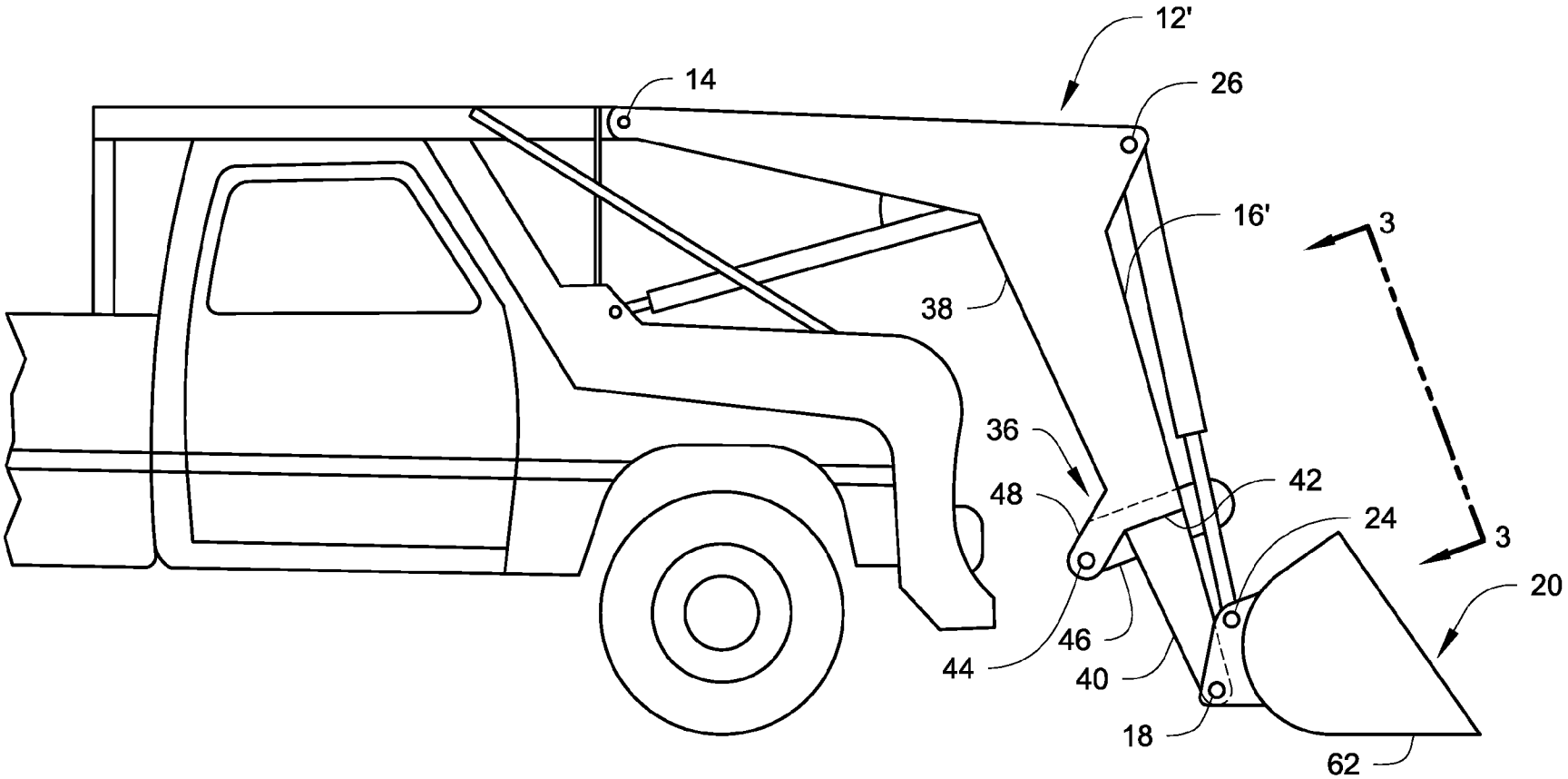
FIG. 2 is a side view of another embodiment of the present invention.

In one embodiment, the linkage assembly is mounted to a front end loader. Referring to the drawings, wherein like reference numerals designate identical or corresponding parts throughout the several views, and more particularly to FIGS. 1A and 1B, the implement in accordance with the present invention is designated generally by the numeral 10. Designations such as front, back, top, bottom, right side and left side are to be referenced to front end loader or the vehicle, particularly from the perspective of the vehicle driver. Implement 10 includes a frame assembly 12 attached to the vehicle (not shown). Frame assembly 12 includes a pair of downwardly projecting legs 16 which are pivotally attached at first pivot points 18 to bucket 20. Hydraulic cylinders 22 are pivotally attached at second pivot points 24 to bucket 20 and also to frame assembly 12 near the top of downwardly projecting legs 16 at third pivot points 26. The frame assembly 12 is pivotally attached at vehicle attachment pivot points 14. In the first embodiment, the hydraulic cylinders 22 are part of a mechanism 28 controlled by control system 30, which in conjunction with sensor 32, causes the bucket 20 to tip back upon striking an immovable object 34 as shown in FIG. 1(B). Sensor 32 senses a change in distance between first and vehicle attachment pivot points 18 and 14 or, alternatively, a change in velocity of bucket 20 or an impact deceleration of bucket 20. That is, when bucket 20 has met immovable object 34, sensor 32 sends a signal to control system 30 which determines if a threshold value of the parameter measured has been reached. If the threshold value has been met, control system 30 actuates a contraction of hydraulic cylinders 22 so that bucket 20 tips appropriately up at the scraping edge and rides up and over the immovable object 34.

Figure 3:
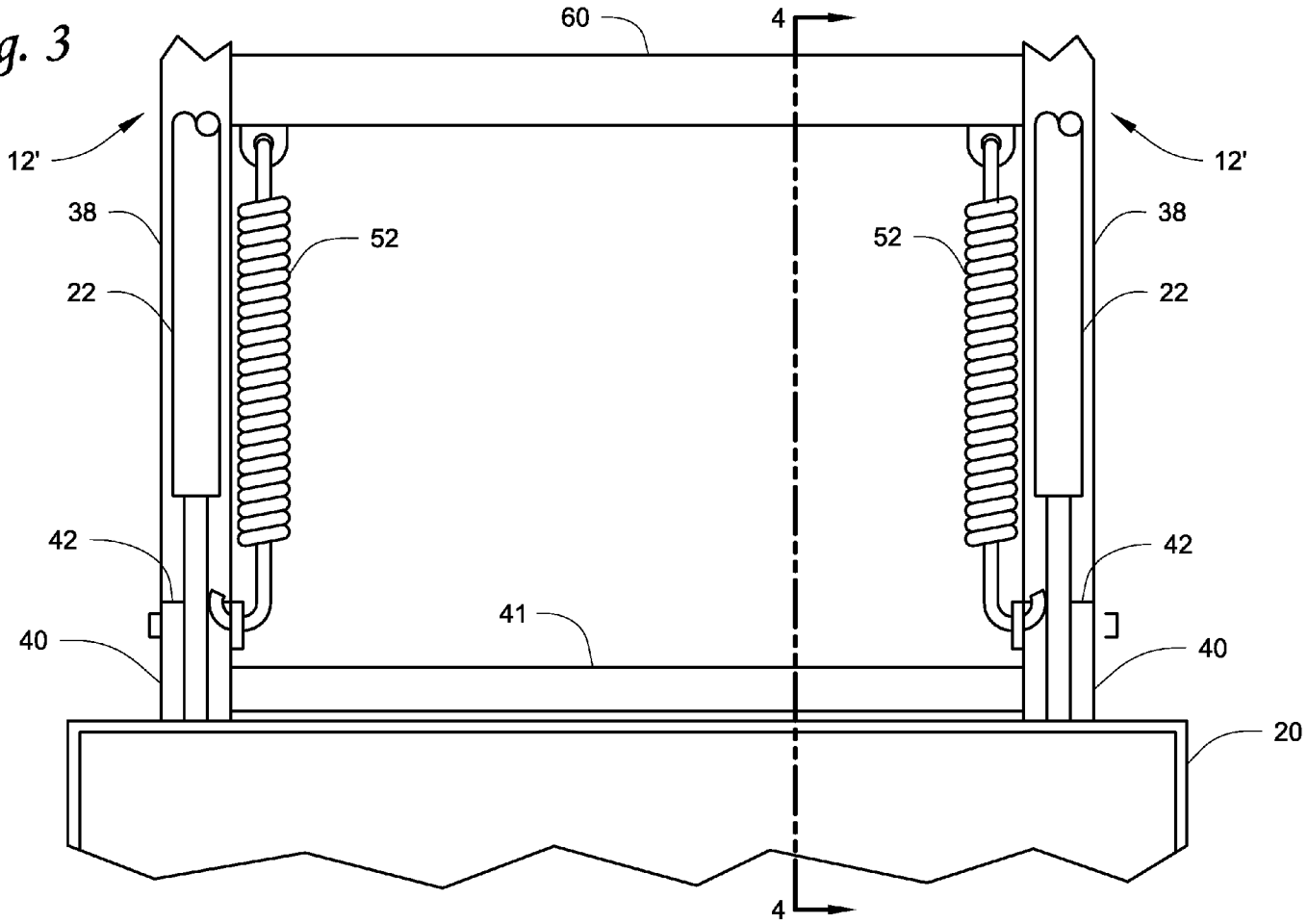
FIG. 3 is an enlarged plan view of the lower bucket assembly as shown in FIG. 2 taken along auxiliary line 3-3.

In another embodiment as shown in FIGS. 2-5(B), there are two downwardly projecting legs 16' which have hinged joints 36 which allow bucket 20 to tip relative to frame assembly 12'. Each downwardly projecting leg 16' has upper and lower portions 38, 40 separated at a break location 42. The two upper portions 38 are rigidly connected by a first cross member 60 as shown in FIG. 3. The two lower portions 40 are rigidly connected by a second cross member 41. The upper portions 38 and lower portions 40 of each of the downwardly projecting legs 16' are rotatably fastened together at fourth pivot point 44. Pivot points 44 have axes lying parallel and located rearwardly of break locations 42. A lever arm 46 is fixedly attached to the lower portion 40 of each of the downwardly projecting legs 16'. Alternatively, lever arm 46 could be a unitary part of the lower portion 40 of the downwardly projecting leg 16'. A mating leg 48 extends rearwardly from each of the upper portions 38 of downwardly projecting legs 16' so that the rearward end of lever arm 46 and mating leg 48 are pivotally attached together at the fourth pivot point 44. The lower portions 40 of the downwardly projecting legs 16' are attached to bucket 20 at first pivot points 18.

Working in conjunction with hinged joints 36 are hinged joint closing devices 50. With respect to FIGS. 4A and 4B, a hinged joint closing device 50 includes a coil spring 52. One end 54 of the spring 52 is attached to a forwardly extending portion 56 of lever arm 46. The other end 58 of the spring 52 is attached to the first cross member 60 which rigidly connects the upper portions 38 of the downwardly projecting legs 16'.

As shown in FIG. 3, there are similar hinged joint closing devices 50 associated with each of the downwardly projecting legs 16'.

Figure 4A:
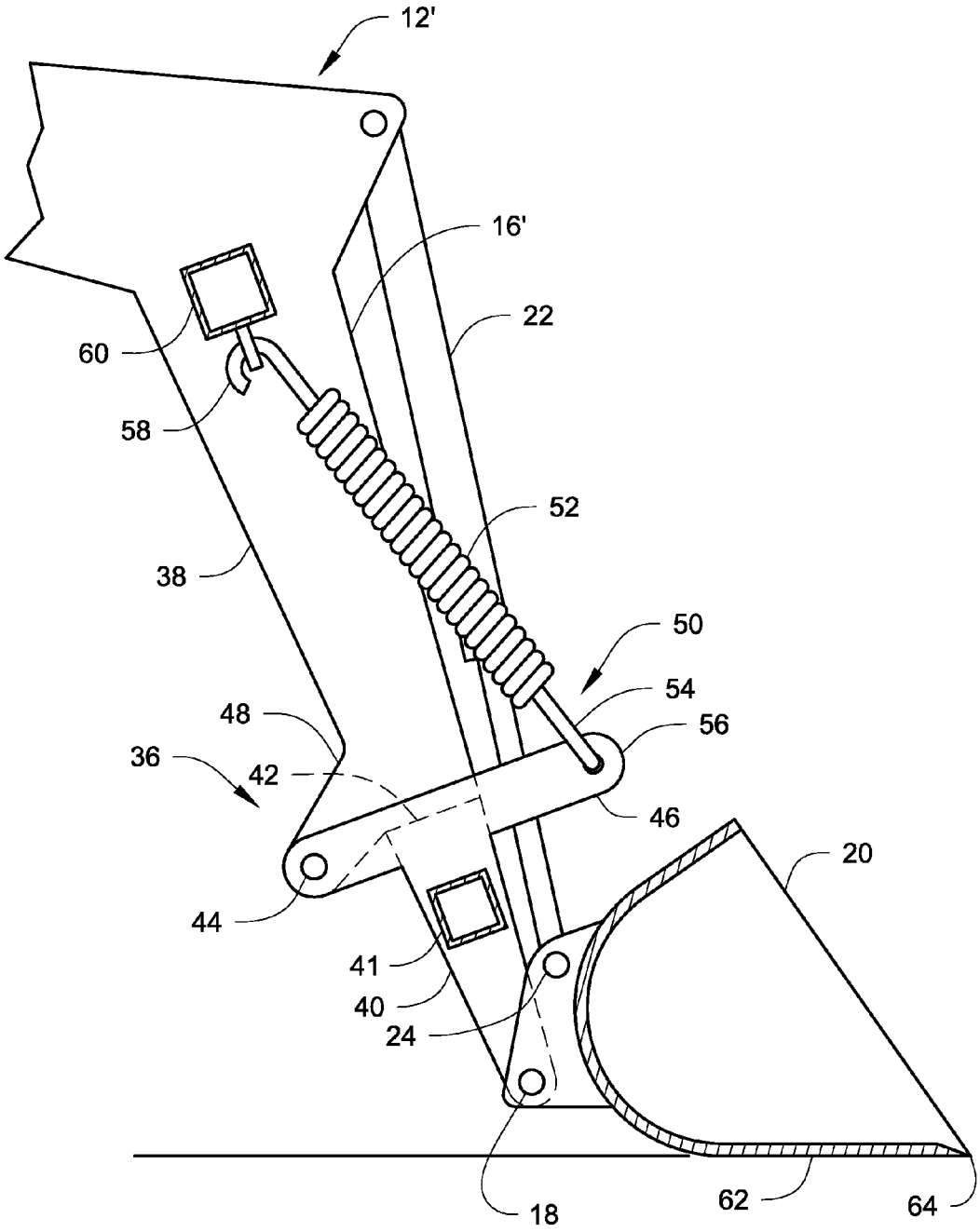
FIG. 4A is a sectional view of the lower bucket assembly as shown in FIG. 3, taken along section line 4-4, showing the assembly in the undeflected position.
Figure 4B:
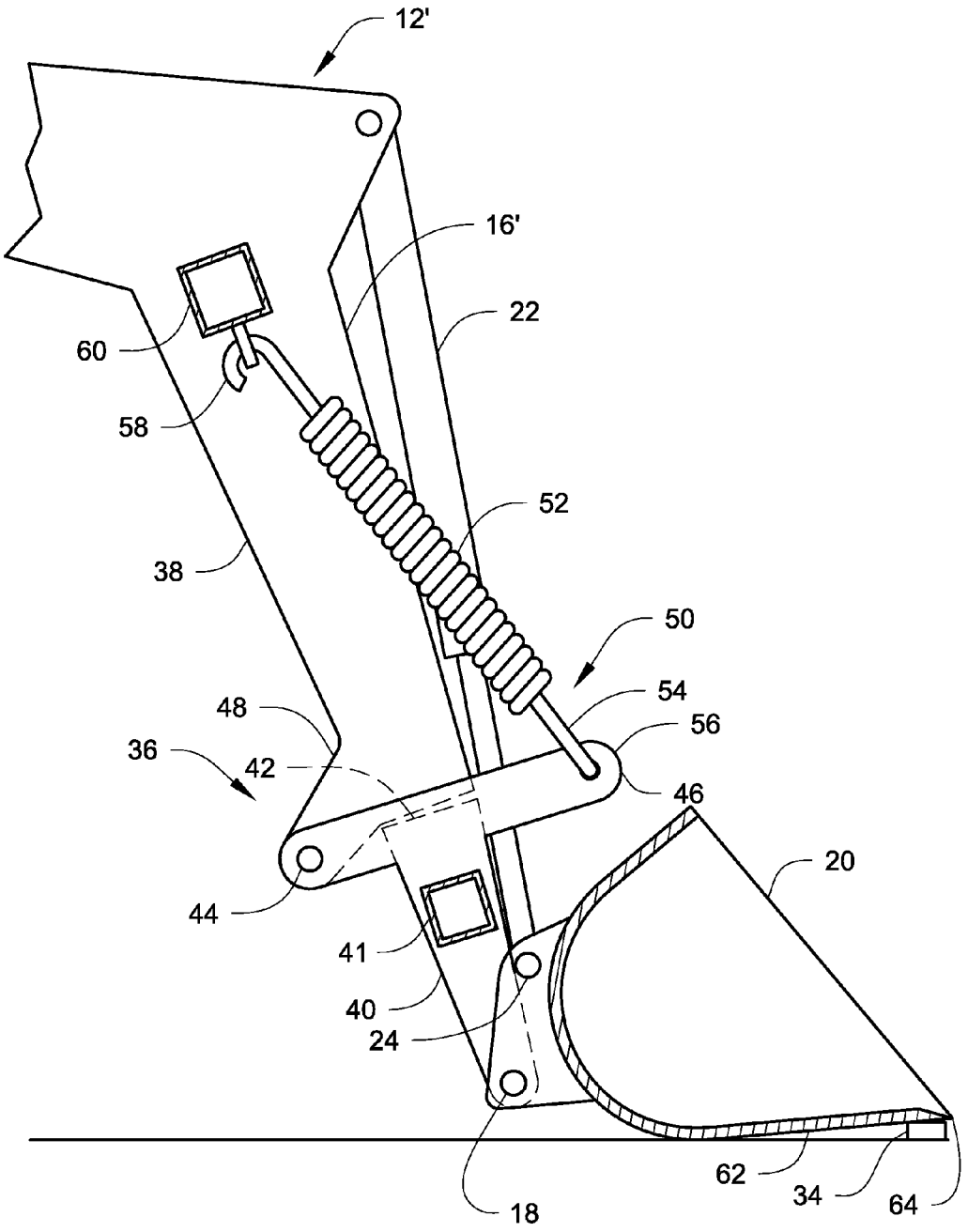
FIG. 4B is a sectional view of the lower bucket assembly as shown in FIG. 3, taken along section line 4-4, showing the assembly in the deflected position as the bucket rides up over a fixed object.

In use, implement 10 is positioned so that the bottom 62 of bucket 20 is flat on the ground so that the front edge 64 scrapes, for example, snow and ice appropriately along the ground. When front edge 64 strikes an immovable object 34 as shown in FIG. 4B, the lower portions 40 of the downwardly projecting legs 16' pivot backward about the fourth pivot points 44. As the lower portion of the downwardly projecting legs 40 pivot backward, the bucket 20 pivots about the second pivot points 24 and first pivot points 18 thereby allowing the front scraping edge 64 of the bucket 20 to lift up and over the immovable object 34. The heel of the bucket remains on the ground. Hydraulic cylinder 22 maintains a constant length during these operations. The impact force of the immovable object 34 is counteracted by the hinged joint closing device 50, or more particularly, springs 52. When the impact force of the immovable object 34 overcomes the counteracting spring force, which is determined by the spring constant, as well as the length of the lever arm 46 relative to the fourth pivot points 44, the front scraping edge 64 of the bucket 20 will lift up and over the immovable object 34 as shown in FIG. 4B. Once the immovable object 34 has been cleared, the springs 52 will pivot the lower portion 40 of the downwardly projecting legs 16' about the fourth pivot points 44 so that the upper portions 38 and the lower portions 40 lie directly adjacent one another in the area of break locations 42, thereby resetting the hinged joint closing device 50.

Figure 5A:
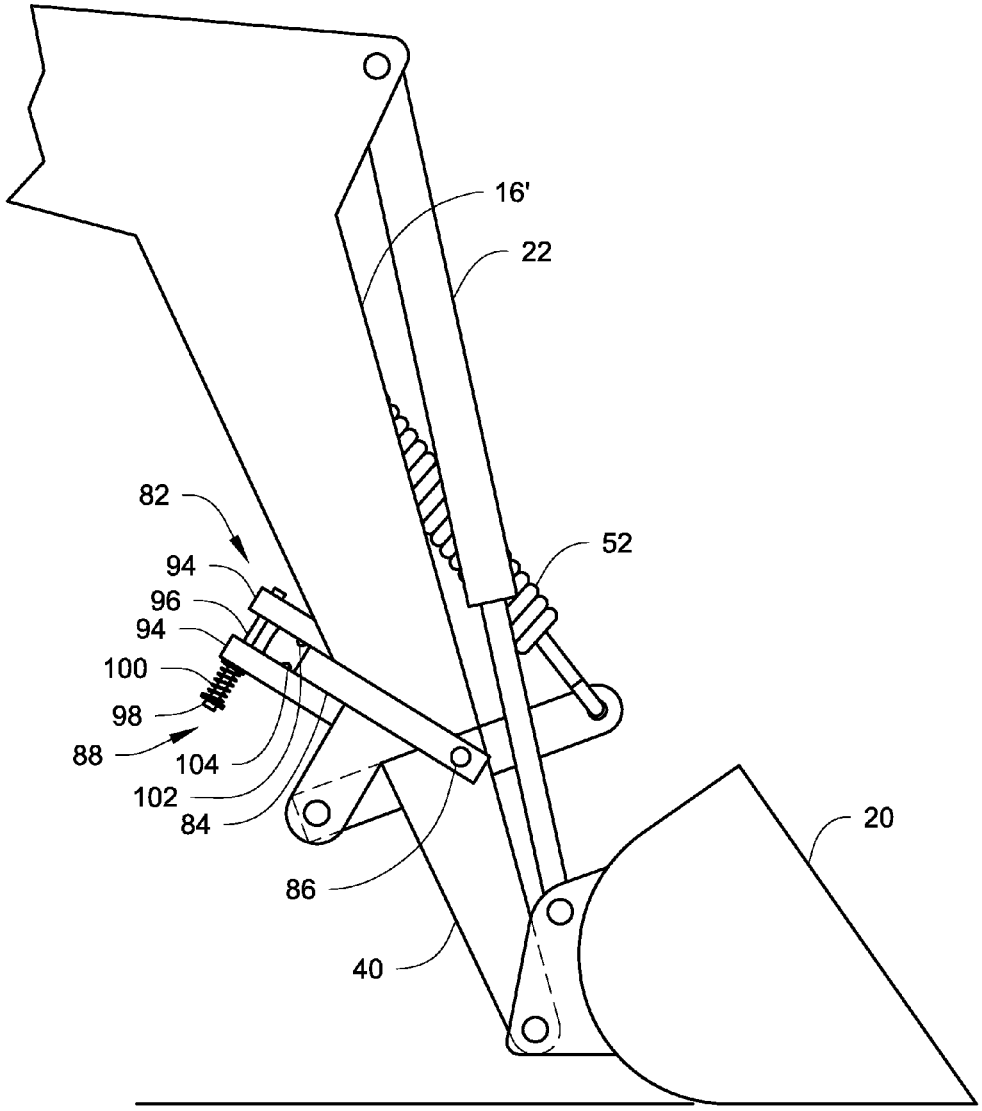
FIG. 5A is a side view of the lower bucket assembly, which includes a nipple and détente mechanism, showing the assembly in the undeflected position.
Figure 5B:
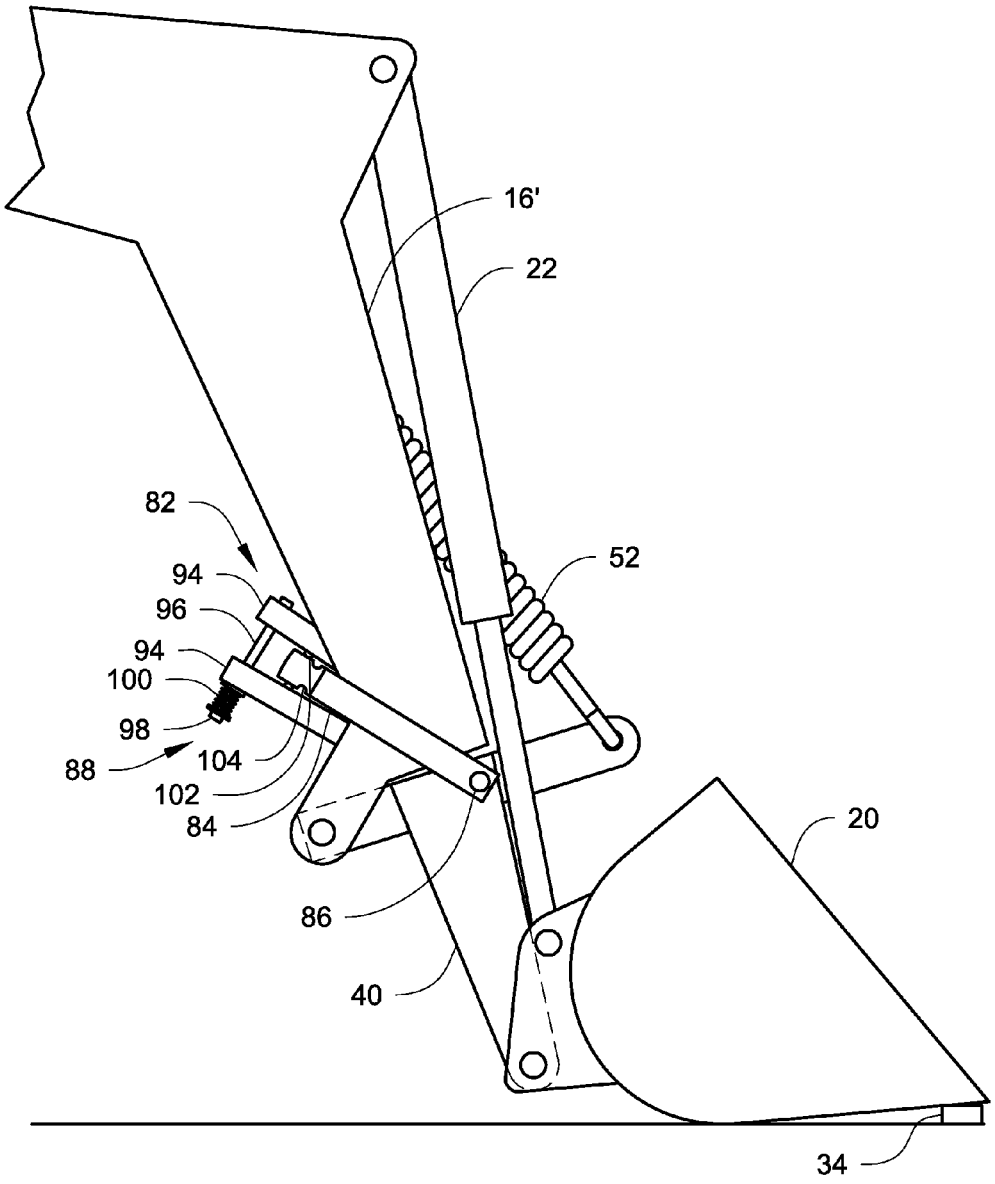
FIG. 5B is a side view of the lower bucket assembly, which includes a nipple and détente mechanism, showing the assembly in the deflected position.

In a further embodiment of implement 10 as shown in FIGS. 5A and 5B, a sensor in the form of a mechanical nipple/détente assembly 82 is disclosed. Nipple/détente assembly 82 includes a détente member 84 pivotally attached to both the right and left sides of the lower portion 40 of each downwardly projecting leg 16' at pivot point 86. The detent member 84 additionally provides a stop which prevents the over-rotation of the lower portion 40 of the downwardly projecting leg 16'. A nipple sub-assembly 88 is pivotally attached to the inside of the upper portion 38 of each downwardly projecting leg 16'. Nipple sub-assembly 88 includes a pair of plates 94, on either side of détente member 84, held together with a bolt 96 and nut 98. A coil spring 100 is provided on bolt 96 between nut 98 and one of plates 94. The combination of nut and bolt 98, 96 and spring 100 provides a force adjustment for nipple/détente assembly 82. That is, if nut 98 is tightened against spring 100, it takes more force to separate plates 94 and allow détente member to pull away and further allow hinged joints 36 to open. Protuberance nipples 102 are provided on each of the plates 94, while indention détentes 104 are located to receive nipples 102 when hinged joints 36 are closed. It is preferred that nipple/détente assembly 82 be a part of appropriate embodiments above.

In use, when an immovable object 34 is struck, if a force is generated above the preset threshold to which spring 100 is adjusted, détente member 84 overcomes the force of the compression spring 100 thereby releasing détente member 84 which allows lower portion 40 to rotate so that the hinge joints 36 open as depicted in FIG. 5B. Once the hinged joints 36 close, nipple/détente assembly 82 resets as in FIG. 5A.

The use of nipple/détente assembly 82 is readily tailored to snowplowing conditions, and may even provide a mechanism for locking out the bucket tilting function during activities such as excavating soil and the like for the front-end loader vehicle.

Figure 6:
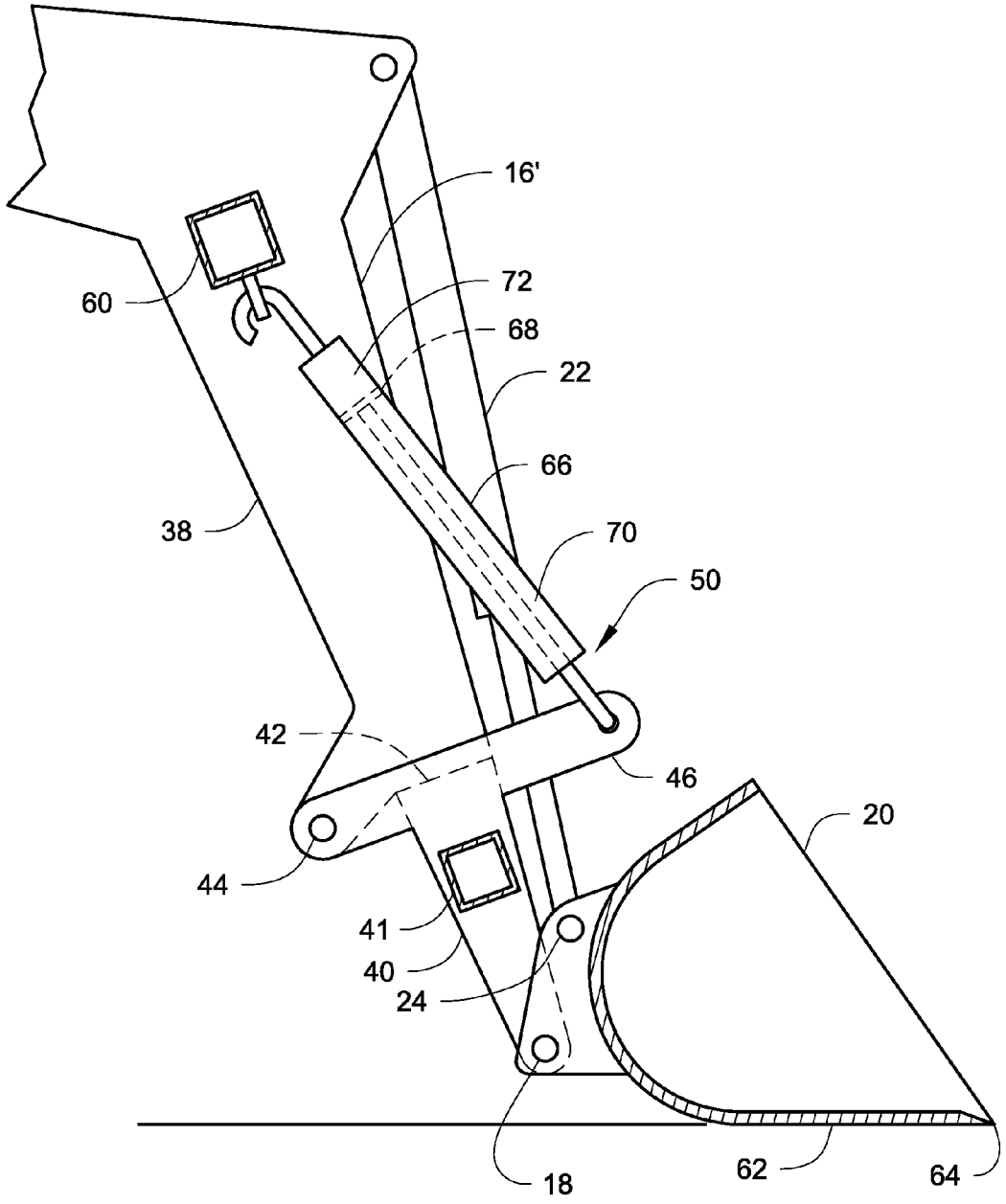
FIG. 6 is a sectional view of the lower bucket assembly of a further embodiment as shown generally in FIG. 3, taken along section line 4-4, showing the assembly in the undeflected position.
Figure 7:
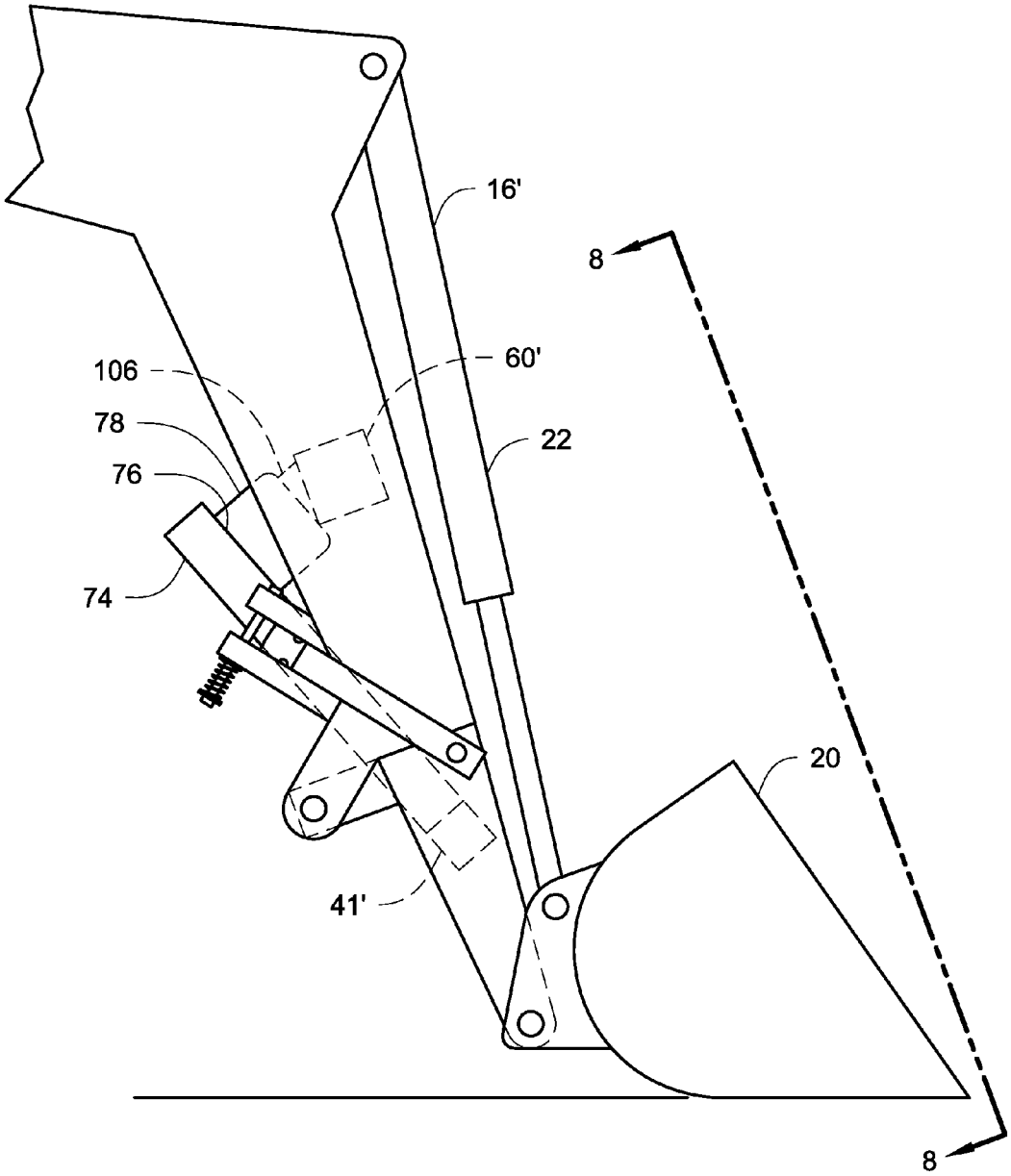
FIG. 7 is a side view of the lower bucket assembly of still another embodiment of the present invention, showing the assembly in the undeflected position.
Figure 8:
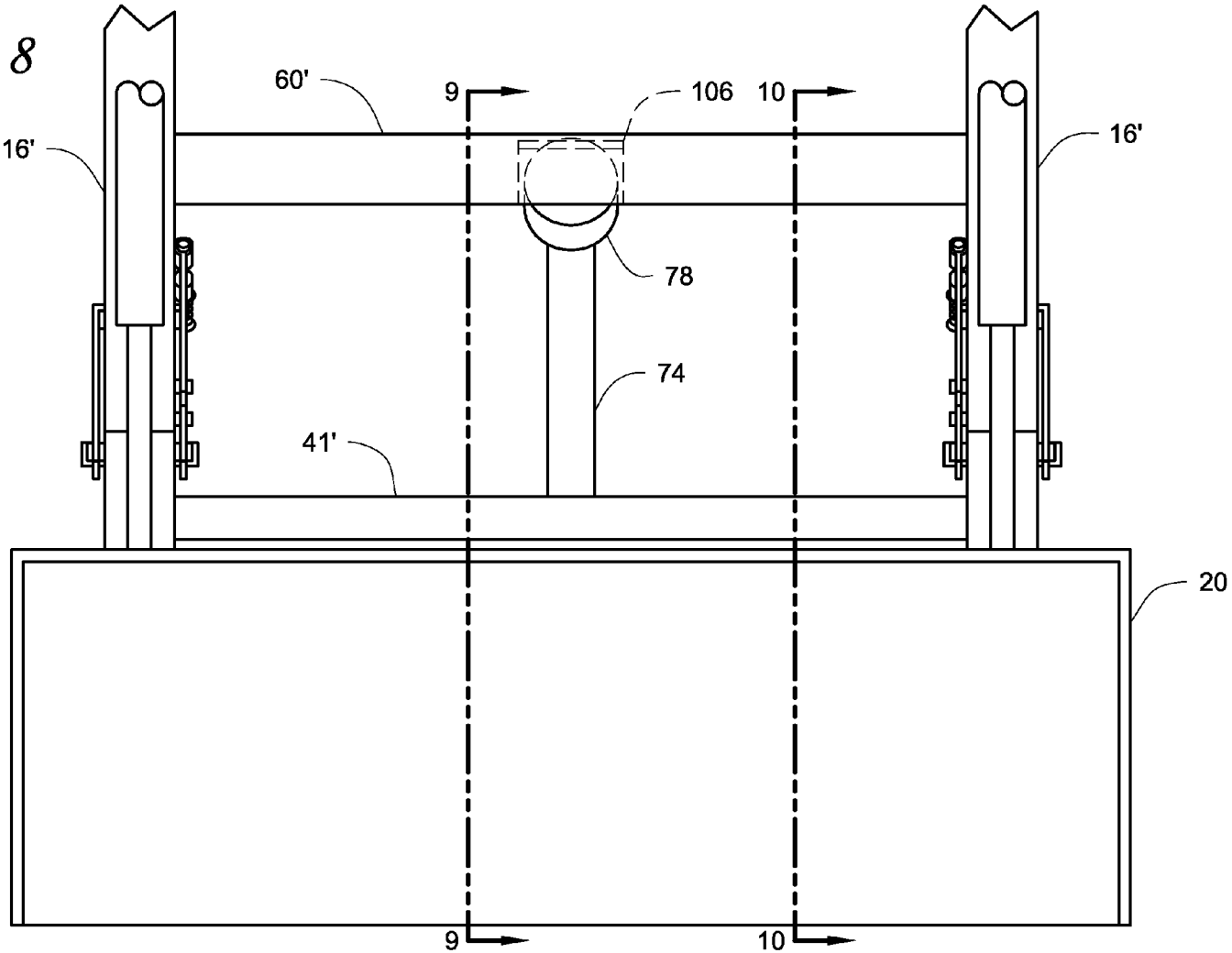
FIG. 8 is an enlarged plan view of the lower bucket assembly as shown in FIG. 7 taken along auxiliary line 8-8.
Figure 9:
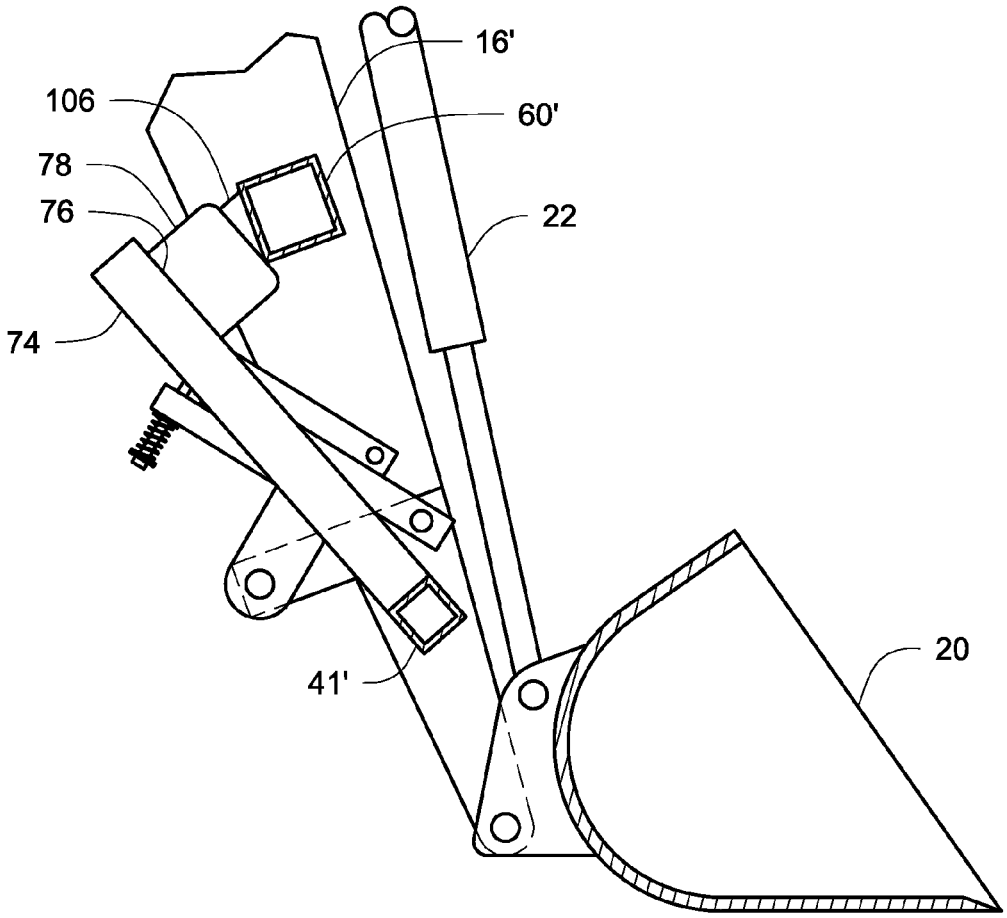
FIG. 9 is a sectional view of the lower bucket assembly as shown generally in FIG. 8, taken along section line 9-9, showing the assembly in the undeflected position.
Figure 10A:
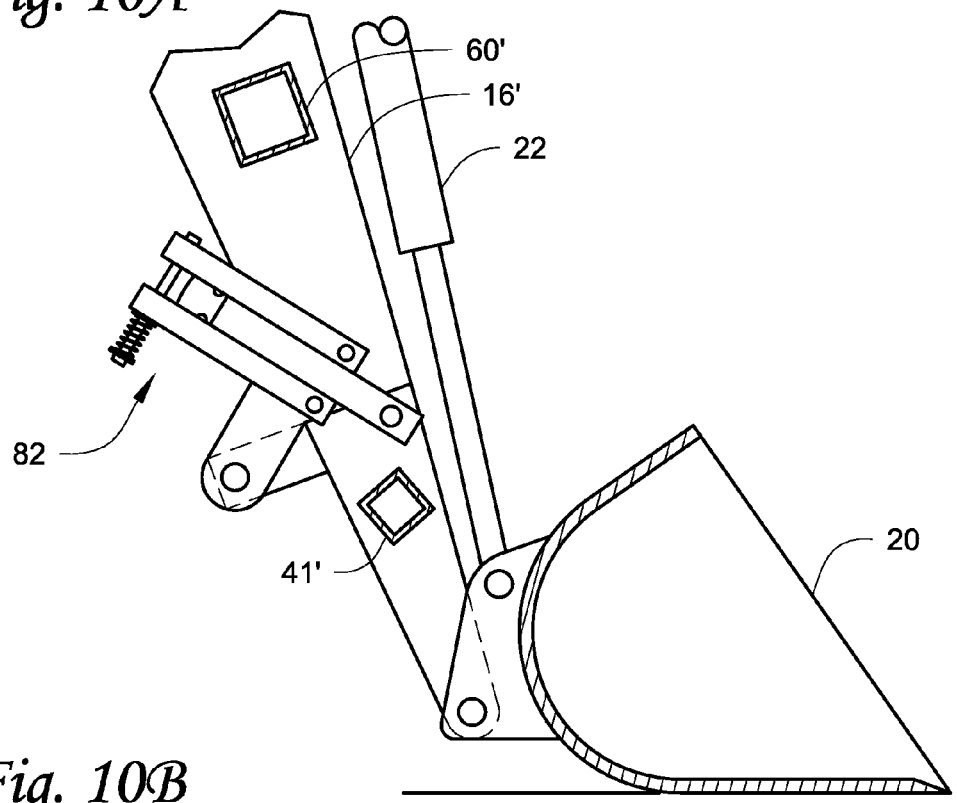
FIG. 10A is a sectional view of the lower bucket assembly as shown in FIG. 8, taken along section line 10-10, showing the nipple and détente mechanism when the assembly is in the undeflected position.
Figure 10B:
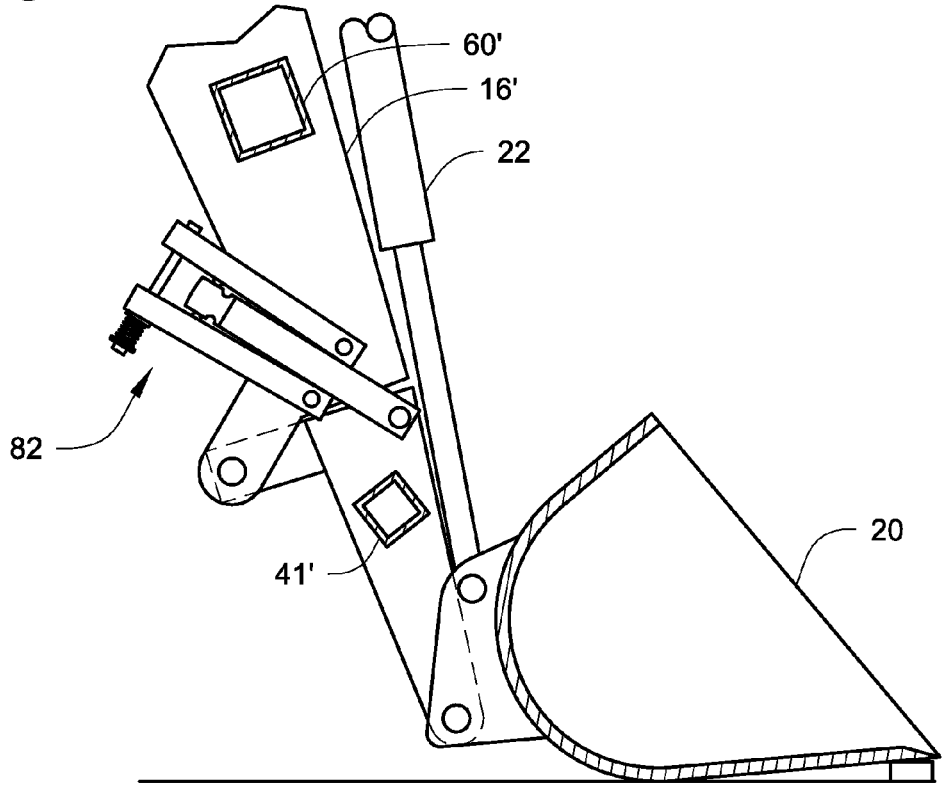
FIG. 10B is a sectional view of the lower bucket assembly as shown in FIG. 8, taken along section line 10-10, showing the nipple and détente mechanism when the assembly is in the deflected position.

In still another embodiment as shown in FIG. 6, springs 52 of the embodiment of FIGS. 2-5B are replaced by fluid-filled (pneumatic or hydraulic) cylinders 66. The rest of the implement is as disclosed. As shown in broken lines, a fluid-filled cylinder 66 includes a piston 68 having first and second chambers 70, 72 on either side of piston 68. When bottom 62 of bucket 20 is sliding along the ground at a level orientation, the first chambers 70 are maintained at a greater pressure than the pressure in the second chambers 72 such that the fluid-filled cylinders 66 provide a biasing force to the end of the lever arms 46.

When front scraping edge 64 strikes an immovable object 34, as similarly shown in FIG. 5B, the lower portions 40 of the downwardly projecting legs 16' pivot backward about the fourth pivot points 44. As the lower portions of the downwardly projecting legs 40 pivot backward, the bucket 20 pivots about the second pivot points 24 and first pivot points 18 thereby allowing the front edge 64 of the bucket 20 to lift up and over the immovable object 34. The first pivot points 18 move in the direction toward bucket 20 relative to the second pivot points 24. Hydraulic cylinder 22 maintains a constant length during these operations. The impact force of the immovable object 34 is counteracted by the hinged joint closing device 50, or more particularly fluid-filled cylinders 66. When the impact force of the immovable object 34 overcomes the counteracting force provided by the fluid-filled cylinders, the front edge 64 of the bucket 20 will lift up and over the immovable object 34. Once the immovable object 34 has been cleared, the fluid-filled cylinders 66 will pivot the lower portion 40 of the downwardly projecting legs 16' about the pivot points 44 so that the upper portions 38 and the lower portions 40 lie directly adjacent to one another in the area of break locations 42, thereby resetting the hinged joint closing device 50.

In the embodiment as shown in FIGS. 7-10B, a different type of fluid-filled or elastomeric device is used. A lever arm 74 is solidly attached to the second cross member 41' near its midpoint. The top end portion 76 of lever arm 74 includes a bumper member 78 comprising a volume-constrained fluid-filled bag, or an elastomeric member, which presses against a bumper coupler member 106 which is attached to a first cross member 60' near its midpoint. When bucket 20 strikes an immovable object 34 causing hinged joint 36 to open, lever arm 74 presses the bumper member 78 against the bumper coupler member 106 thereby causing it to deform. This deformation stores energy in the bumper member 78 as either increased fluid pressure in the case of the volume-constrained bag, or as stored elastic energy in the case of an elastomeric member. The deformation of the bumper member 78 opposes the opening of hinged joints 36 and urges them closed. As this occurs, bucket 20 rides over immovable object 34 as discussed earlier.

Figure 11A:
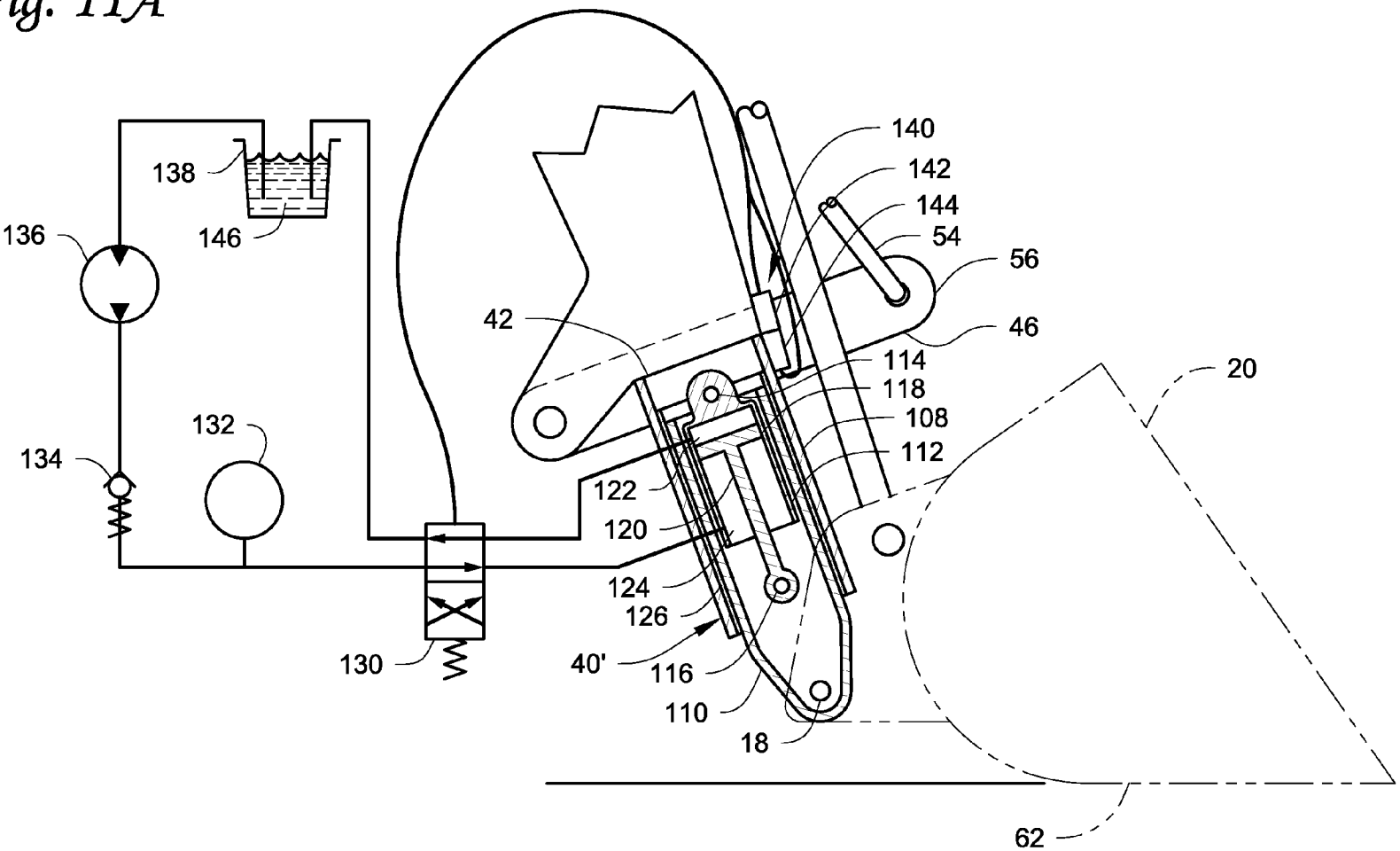
FIG. 11A is a partial side view of the lower bucket assembly of yet another embodiment as shown in FIG. 2, showing a divided lower portion of a downwardly projecting leg, and a hydraulic cylinder (and associated hydraulic circuit) which controls its overall length, in the undeflected position.
Figure 11B:
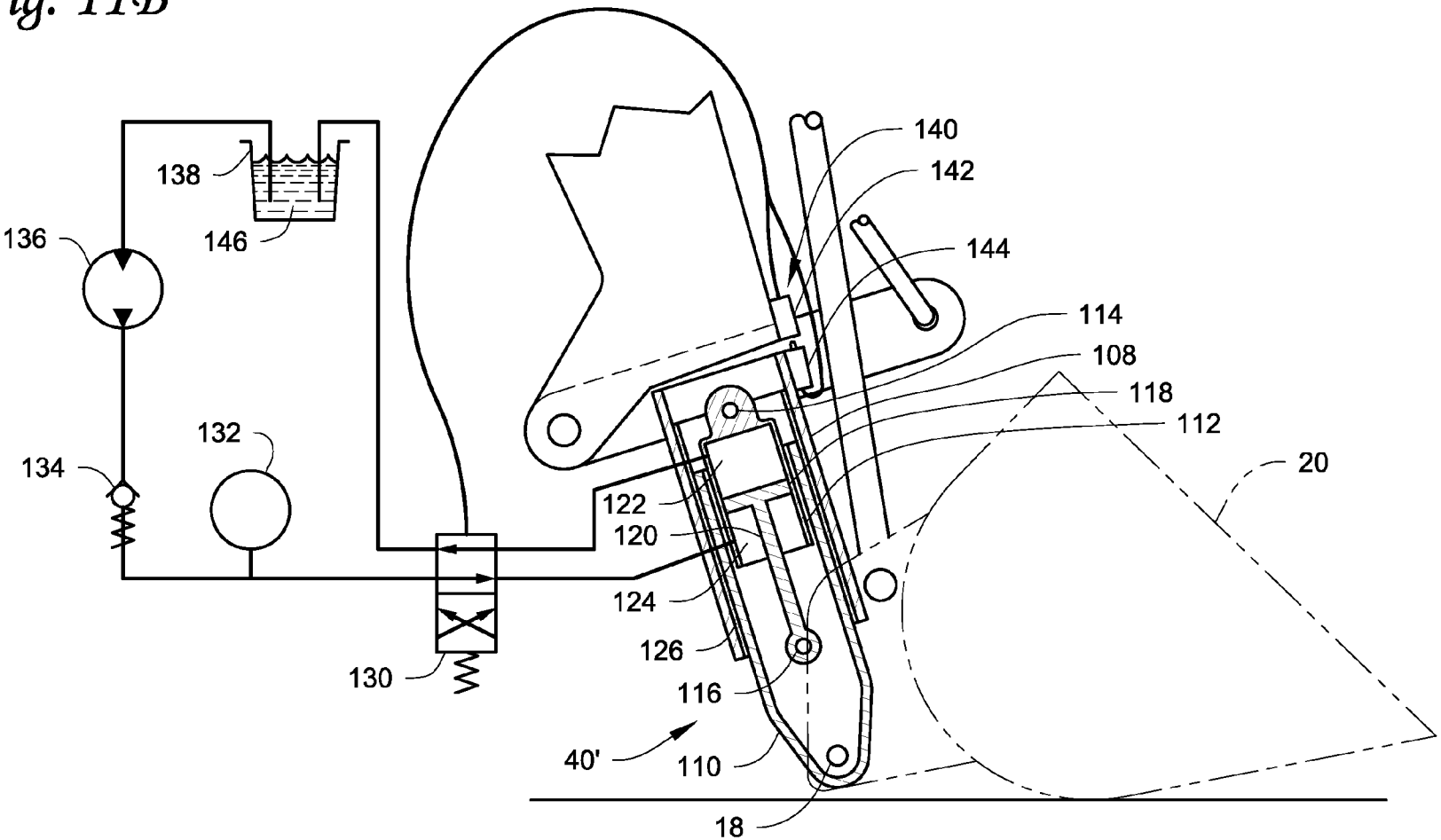
FIG. 11B is a partial side view of the lower bucket assembly of the embodiment of FIG. 11A as shown in FIG. 2, showing a divided lower portion of a downwardly projecting leg, and a hydraulic cylinder (and associated hydraulic circuit) which controls its overall length, in the deflected position.
Figure 12A:
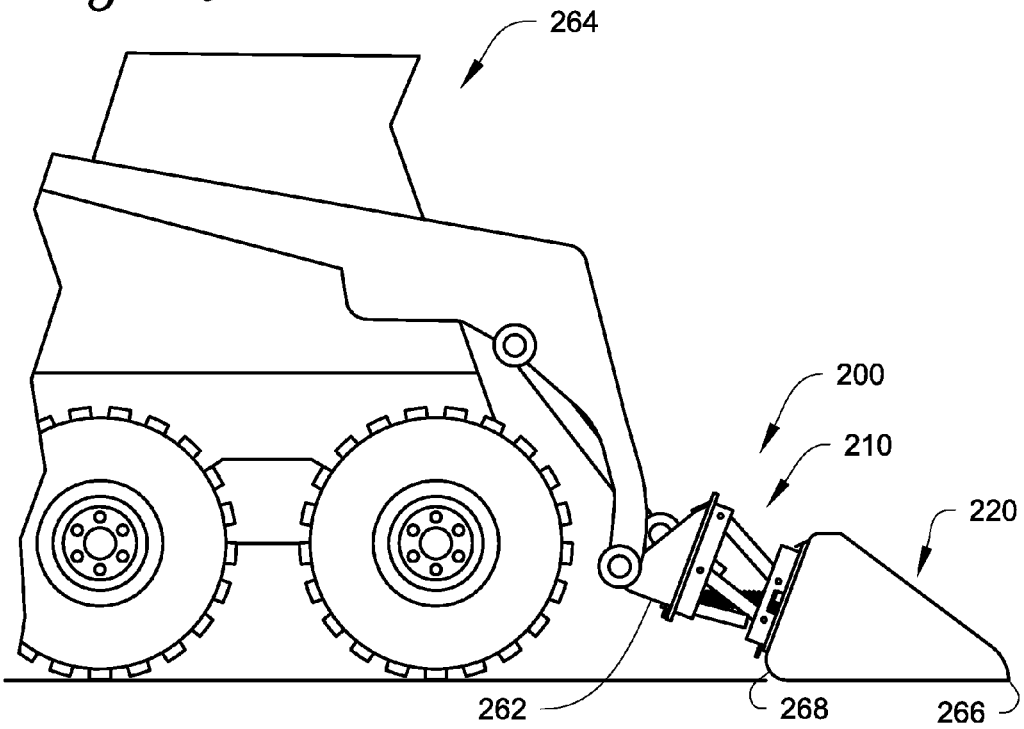
FIG. 12A is a side view of a loader with a quadrilateral linkage connecting a bucket to the loader, when the quadrilateral linkage is not activated.
Figure 12B:
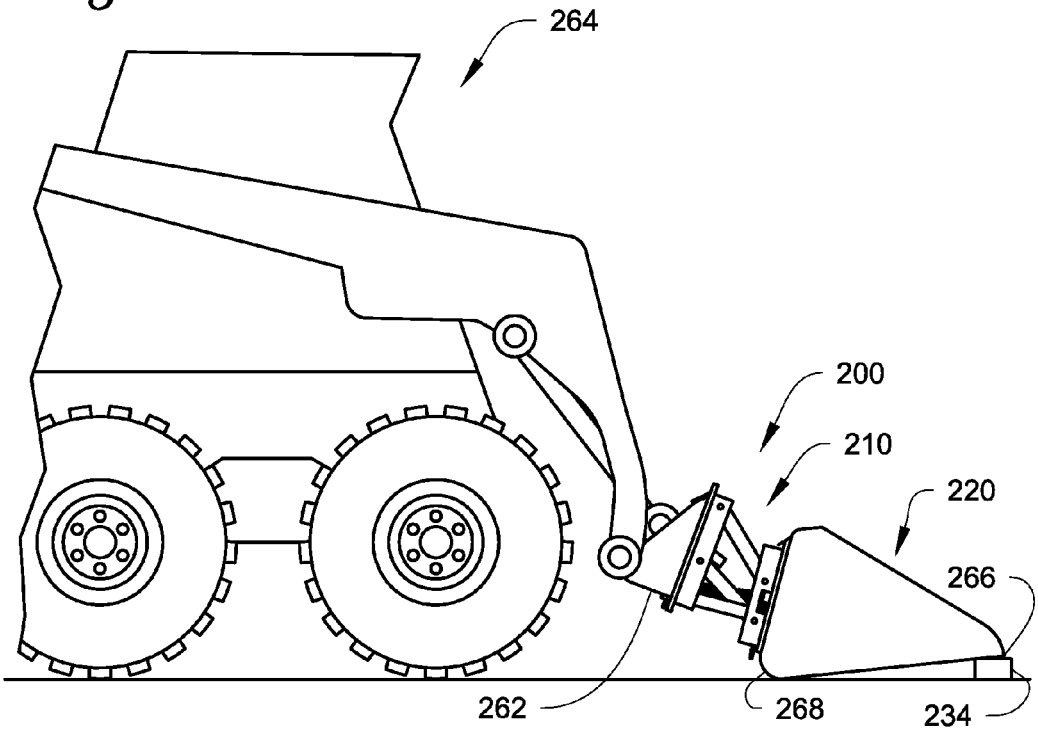
FIG. 12B is a side view of a loader with a quadrilateral linkage connecting a bucket to the loader, when the quadrilateral linkage is activated.

In the embodiment as shown in FIGS. 11A and 11B, a lower portion of a downwardly projecting leg 40' is divided into a top portion 108 and a bottom portion 110. The top portion 108 is slidably connected to the bottom portion 110 with a bearing member 126 there between, and a hydraulic cylinder 112 is attached to the top portion 108 at top hydraulic cylinder coupling 114, and to the bottom portion 110 at bottom hydraulic cylinder coupling 116. The hydraulic cylinder 112 contains a hydraulic cylinder piston 118 and a hydraulic cylinder piston rod 120. An upper cavity 122 is located in the hydraulic cylinder 112 above the piston 118, and a lower cavity 124 exists below the piston 118. A hydraulic circuit 150 activates the hydraulic cylinder 112. The hydraulic circuit 150 includes a reservoir 138, a hydraulic pump 136, a check valve 134, a fast-acting gas-filled accumulator 132, and a solenoid valve 130. A sensor 140 is connected to the solenoid 130 and determines its position. In one embodiment, the sensor 140 comprises a switch 142, 144, located across break location 42.

In use, the lower portions of the downwardly projecting legs appear as in FIG. 11A. The hydraulic pump 136 supplies pressurized hydraulic fluid 146 through check valve 134 to the fast-acting gas-filled accumulator 132. Solenoid valve 130 is in a position which supplies the hydraulic pressure from the hydraulic pump 136 and fast-acting gas-filled accumulator 132, preferably nitrogen accumulator, to the lower cavity 124 of the hydraulic cylinder 112 which maintains the lower portion of the downwardly projecting leg 40' in its shortest configuration. When an immovable object is struck by the bucket 20, the break location 42 opens up sufficiently to cause sensor 140 to send a signal to the solenoid valve 130, causing it to switch to the location depicted in FIG. 11B. When the solenoid valve 130 shuttles its position, hydraulic fluid 146 immediately rushes to the upper cavity 122 of the hydraulic cylinder 112, thereby causing the hydraulic cylinder piston 118 to move downward, thus pushing the bottom portion of the lower portion of the downwardly projecting leg 110 to move away from the top portion of the lower portion of the downwardly projecting leg 108. This extension causes the bucket 20 to tilt upwardly about the first pivot point 18 and the second pivot point 24. Furthermore, the mechanics of elongating the lower portion of the downwardly projecting leg 40' are such that the degree of upward tilting of the bucket 20 is amplified by this increased length.

The mechanism of this embodiment is preferably used as a safety device in cases where the magnitude of the collision impulse is large, e.g. where large immovable objects are struck by the bucket 20, such as in the case when a curb is struck with the bucket 20. The threshold of sensor 140 or switch 142, 144 would be set so that this mechanism is activated only upon hitting an immovable object large enough or rigid enough so as to cause a large impulse to the loader and its occupant(s). After such a jarring collision, the mechanism would be reset by the operator of the vehicle, after inspecting the vehicle for damage. By amplifying the amount of rotation which bucket 20 may make in the case of extreme collisions, injury to the occupant(s) and damage to the loader can be prevented.

In yet a further embodiment as shown in FIGS. 12A-17B, the linkage assembly 200 includes a quadrilateral linkage 210 and connects to the working assembly. It will be appreciated that the forward motion-producing machine or, in this case, a vehicle, which may be ATV, farm tractor, skid loader, pickup truck, or other vehicle and that the implement may function to clear snow, manure or other material.

The linkage assembly 200 includes a front plate 260 that connects conventionally to the working assembly or, in this case, the bucket 220 of the loader vehicle 264 and a rear plate 212 that connects conventionally to the vehicle. With respect to the quadrilateral linkage 210, the front plate 260 connects at braces 304 to a first pair of arms 216 at first pivot points 218 and to a second pair of arms 222 at second pivot points 224. The rear plate 212 connects at braces 302 to the second pair of arms 222 at third pivot points 226 and the first pair of arms 216 at fourth pivot points 214. The first pair of arms 216 is shorter than and non-parallel to the second pair of arms 222. Pins forming the various pivot points or axes are bolts and nuts or other appropriate fasteners (not shown).

Figure 13B:
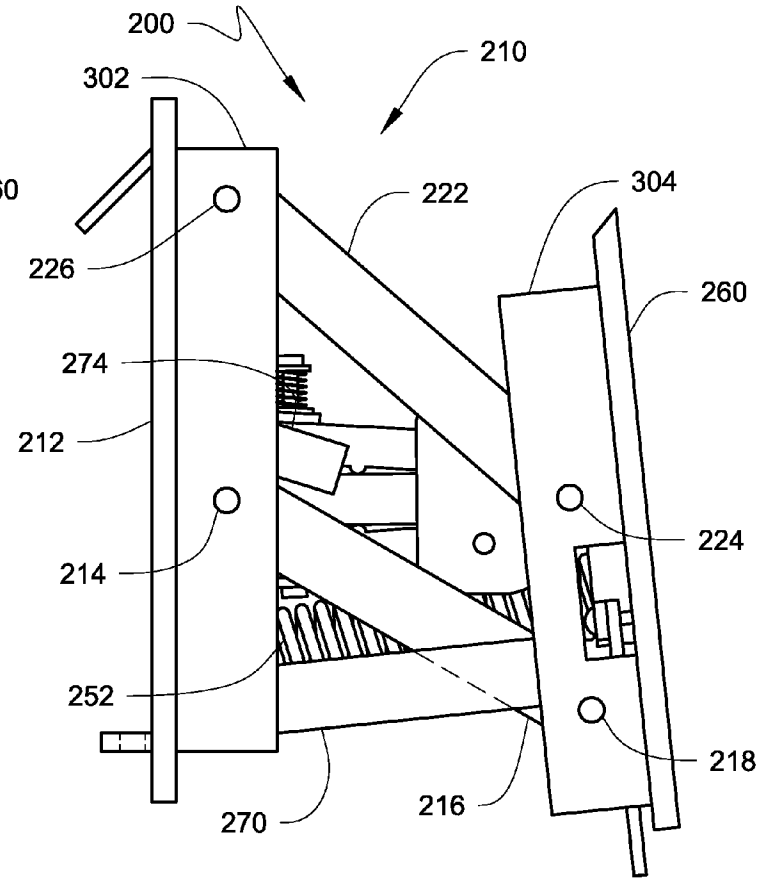
FIG. 13B is an enlarged side view of the quadrilateral linkage of FIG. 12B, when the quadrilateral linkage is activated.
Figure 13A:
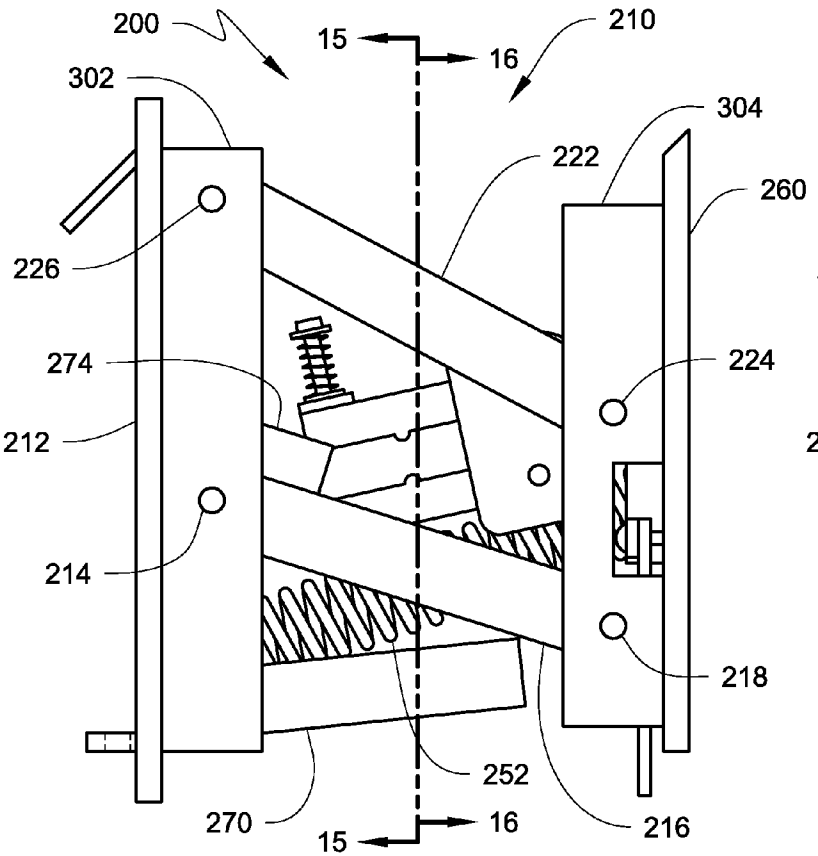
FIG. 13A is an enlarged side view of the quadrilateral linkage of FIG. 12 A, when the quadrilateral linkage is not activated.
Figure 14:
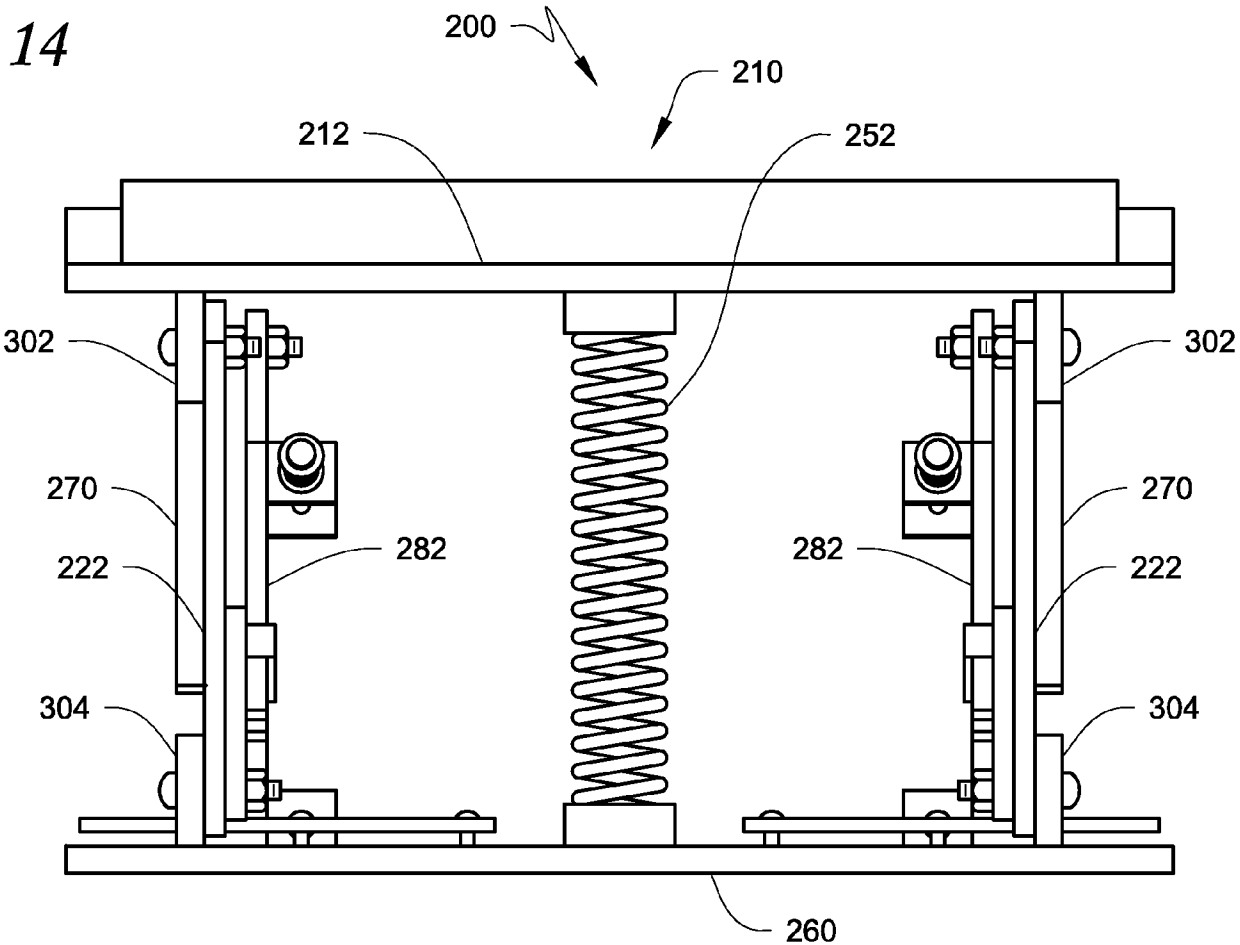
FIG. 14 is a top view of the quadrilateral linkage.
Figure 15:
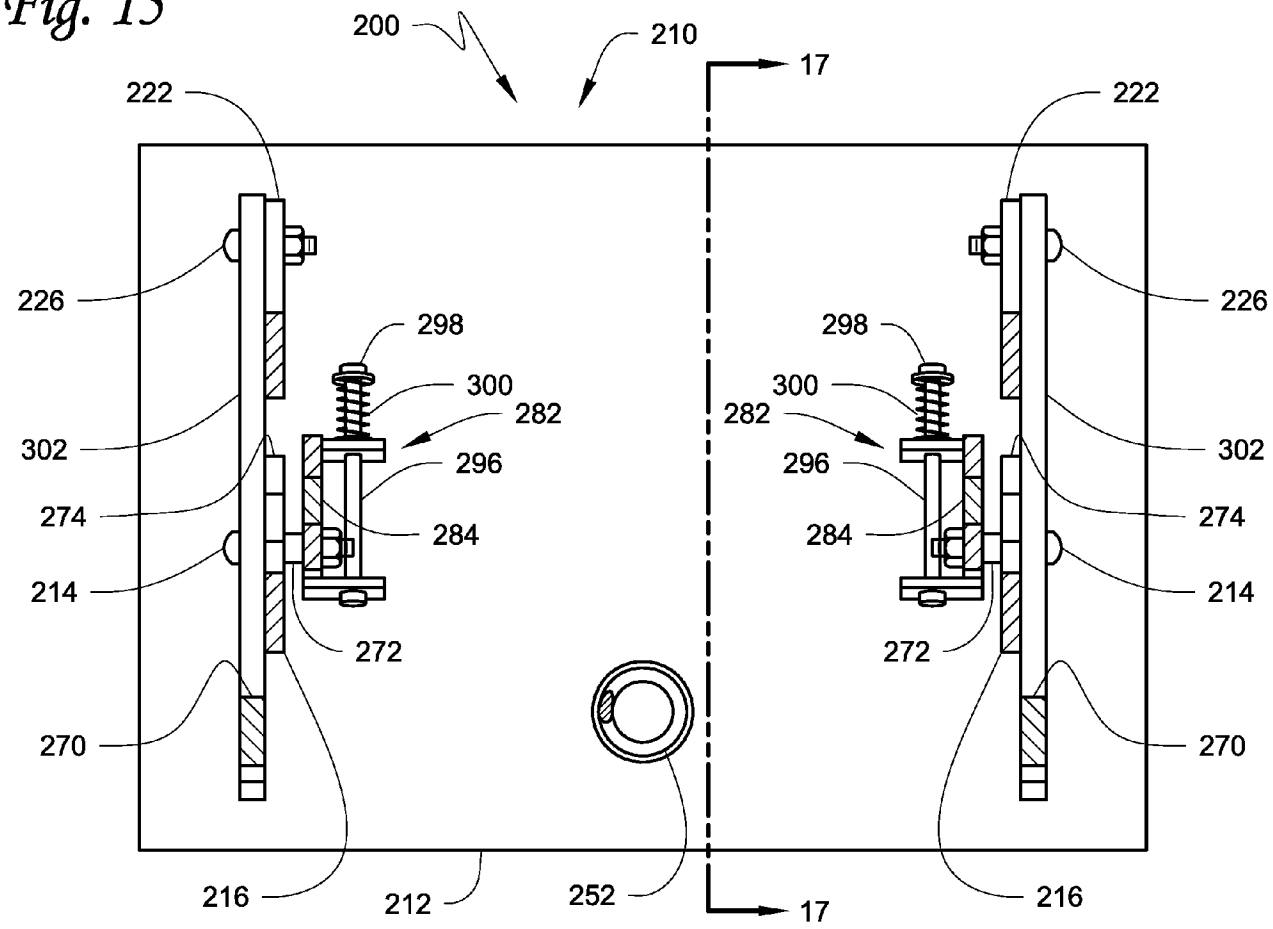
FIG. 15 is a sectional view of the quadrilateral linkage as shown in FIG. 13A, taken along section line 15-15, showing the rear plate.
Figure 16:
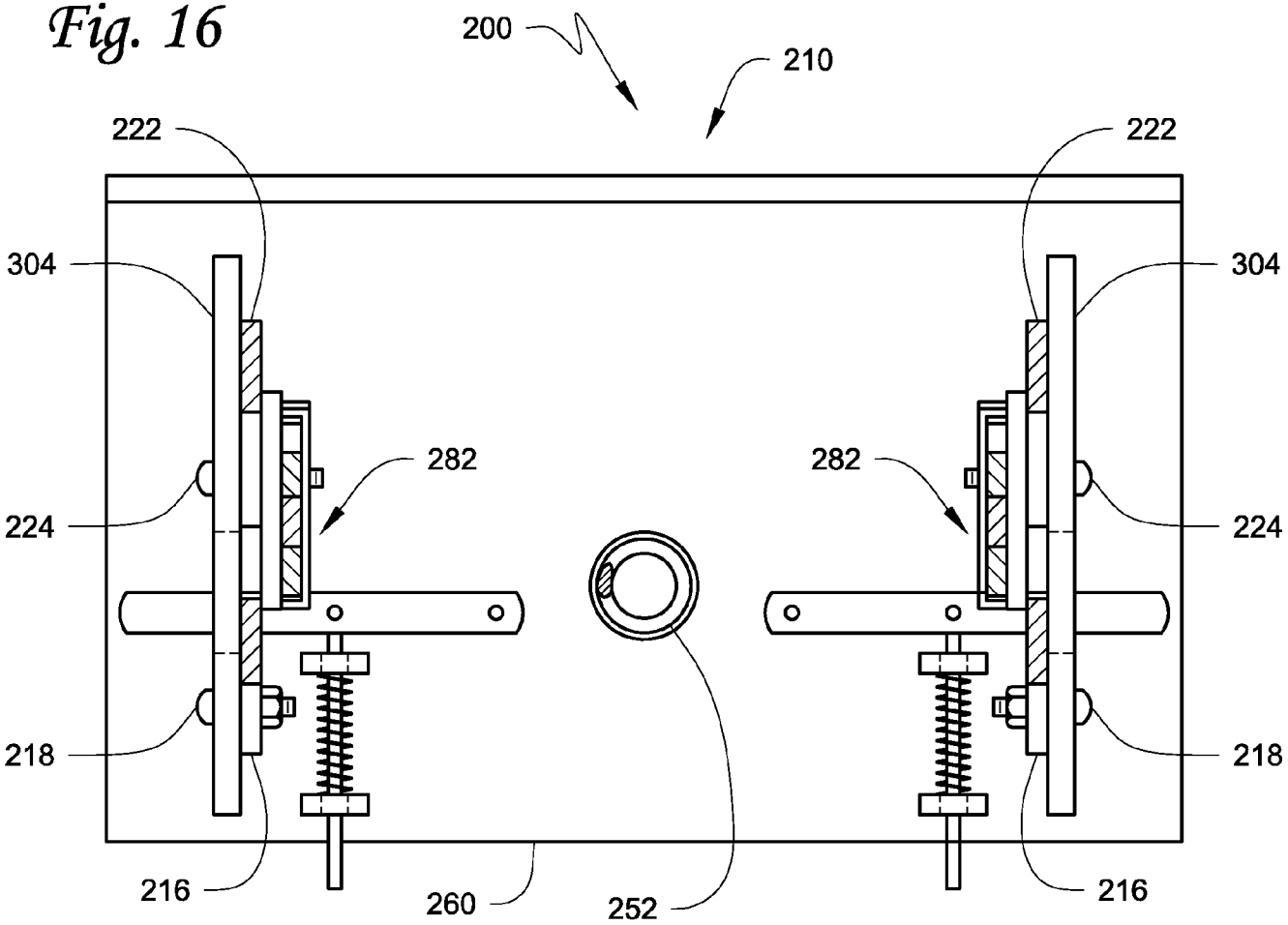
FIG. 16 is a sectional view of the quadrilateral linkage as shown in FIG. 13A, taken along section line 16-16, showing the front plate.

The linkage assembly 200 has an inactivated state or first configuration as shown in FIG. 13A and an activated state or second configuration as shown in 13B. In the inactivated state, the linkage assembly 200 is urged to its designed limit by a bias member, such as a spring 252. The linkage assembly 200 is activated when a scraping edge 266 of the bucket 220 strikes an immovable object 234. During this process, the spring 252 is compressed and the quadrilateral linkage 210 is likewise compressed. The first pivot axis 218 moves in the direction of the bucket 220 relative to the second pivot axis 224 so that the bucket 220 is tilted at its heel 268 and the scraping edge 266 is elevated and rides up and over the immovable object 234.

The linkage assembly 200 may also include a first stopper device 270 to prevent over compression in the activated state and a second stopper device 274 to determine the design limit of the inactivated state. Stopper device 270 is attached to a brace 302 and extends forwardly toward plate 260 and when there is a hard impact stopper device 270 contacts plate 260 and solidifies linkage assembly 200. There could be more than one stopper device 270. Stopper device 274 is located to contact one of the front and rear plates 260, 212 and one of the first and second pair of arms 216, 222 when linkage assembly 200 is in the inactivated state. Likewise, there could be more than one stopper device 274.

The linkage assembly 200 may also include a mechanical nipple and détente assembly 282. As similarly described with respect to an earlier embodiment, the nipple and détente assembly 282 includes a détente member 284 pivotally attached to the rear plate 212 at pivot point 272 (shown attached to rear plate 212 at brace 302) and a nipple sub-assembly 306 pivotally attached to the front plate 260 at a pivot point 286 (shown attached to front plate 260 at brace 304). It will be appreciated that the nipple and détente assembly 282 can be attached anywhere between the front and rear plates 260 and 212 in any appropriate position, for example, attaching the détente member 284 to the front plates 260 and attaching the nipple sub-assembly 306 to the rear plate 212. The nipple sub-assembly 306 includes a pair of plates 308, on either side of détente member 284, which are held together at one end with a bolt 296 and nut 298. A bracket 310 is pivotally attached at the pivot point 286 and plates 308 are pivotally attached to bracket 310 at the other end of plates 308. A coil spring 300 is provided on bolt 296 between nut 298 and one of plates 308. The combination of nut and bolt 298, 296 and spring 300 provides a force adjustment for nipple/détente assembly 282. That is, if nut 298 is tightened against spring 300, it takes more force to separate plates 308 and allow détente member to pull away and further allow the quadrilateral linkage 210 to activate. Protuberance nipples 312 are provided on each of the plates 308, while indention détentes 314 are located to receive nipples 312 when linkage 210 is inactivated. The nipple and détente assembly 282 provides an extra retention mechanism in addition to the elastomeric force provided by the spring 252 for any impact force to overcome caused by the scraping edge striking an immovable object.

In use, the loader vehicle operator operates the hook 262 to scoop the rear plate 212 of the quadrilateral linkage 210 and then uses the front plate 260 of the linkage 210 to scoop the bucket 220. In the inactivated state, the linkage 210 is urged to its designed limit by the spring 252 against stopper device 274. The linkage 210 is activated when the scraping edge 266 of the bucket 220 strikes an immovable object 234. During this process, the spring 252 is compressed and the quadrilateral linkage 210 is likewise compressed. The first pivot axis 218 moves in the direction of the bucket 220 relative to the second pivot axis 224 so that the bucket 220 is tilted at its heel 268 and the scraping edge 266 is elevated and rides up and over the immovable object 234. In the case of a heavy impact, plate 260 may contact stopper device 270.

It is noted that it has been found advantageous for the first pair of arms 216 to be inclined relative to the horizontal or a line approximately parallel with the prevailing ground surface at an angle of about 70° (see angle a in FIG. 13A). In this regard, when linkage assembly 200 moves to the activated state, it has been found to be preferable for first pair of arms 216 to increase angle a to approximately 90° with respect to the horizontal or a line generally parallel with the prevailing ground surface. These angles are not a necessary condition, but, as indicated, lead to certain advantages. If angle is significantly less than 70 degrees in the inactivated state the impact must be somewhat greater to being linkage assembly movement from inactivated to activated states. If angle a is greater than 90 degrees in the activated state, the linkage apparatus will function but the speed with which edge 266 elevates will decrease.

Further, it has been found to be advantageous to locate first pivot points 218' as low to the prevailing ground surface as possible, namely, high enough in braces 304 so as to be structurally sound, but low enough in braces 304 so that the braces do not interfere with the prevailing ground surface when linkage assembly 200 moves from the inactivated state to the activated state. For Example, first pivot points 218' are well located when the ends of braces 304 are less than one inch from the ground when the linkage assembly 200 is in the second configuration and when the first pivot points 218' are less than one inch from the ends of braces 304.

Figure 17B:
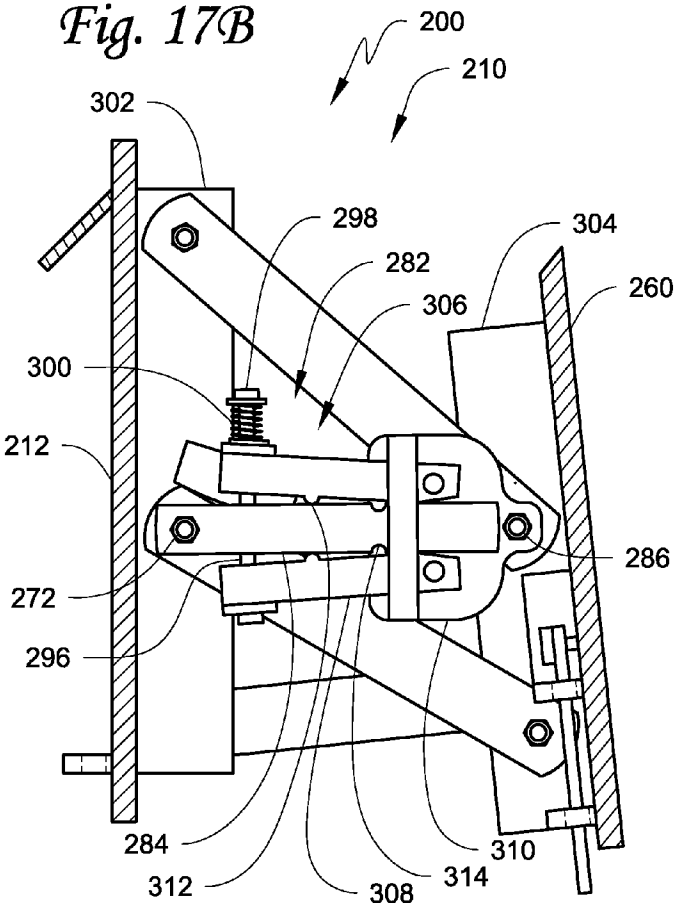
FIG. 17B is a side sectional view of the quadrilateral linkage including the nipple and détente assembly, when the quadrilateral linkage is activated.
Figure 17A:
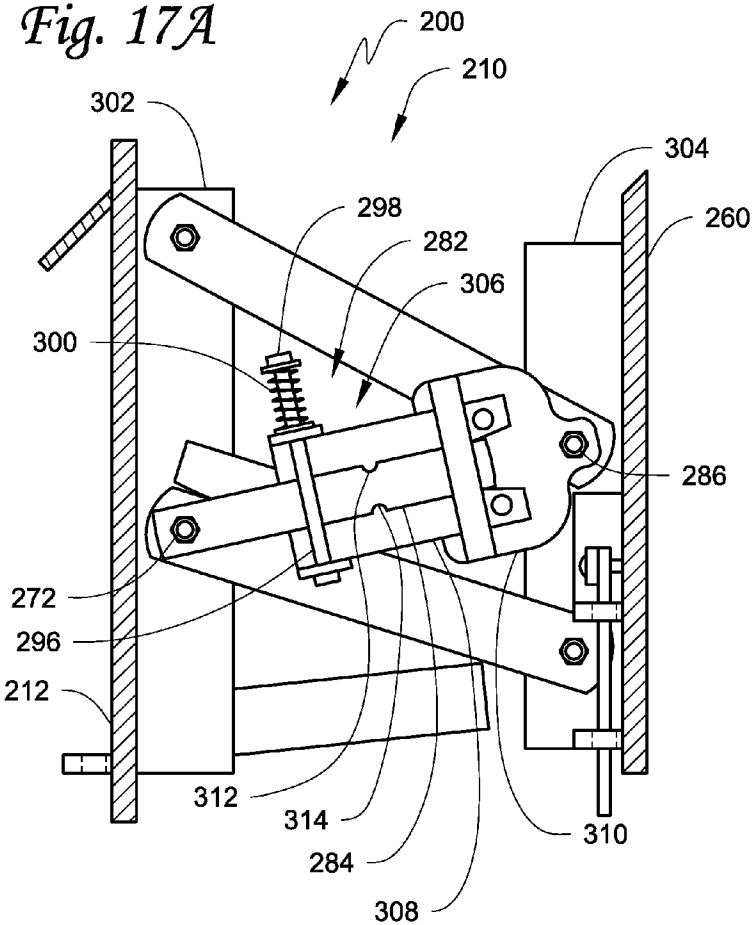
FIG. 17A is a side sectional view of the quadrilateral linkage including a nipple and détente assembly, as shown in FIG. 15, taken along section line 17-17, when the quadrilateral linkage is not activated.

In an embodiment where a nipple/détente assembly 282 is present when an immovable object 234 is struck and a force is generated above the preset threshold force, the détente member 284 overcomes the force of the spring 300 thereby releasing détente member 284 which allows the front plate 260 to be compressed toward the rear plate 212 as depicted in FIG. 17B. Once linkage 210 is urged back to the inactivated state, the nipple and détente assembly 282 resets as in FIG. 17A.

Figure 18A:
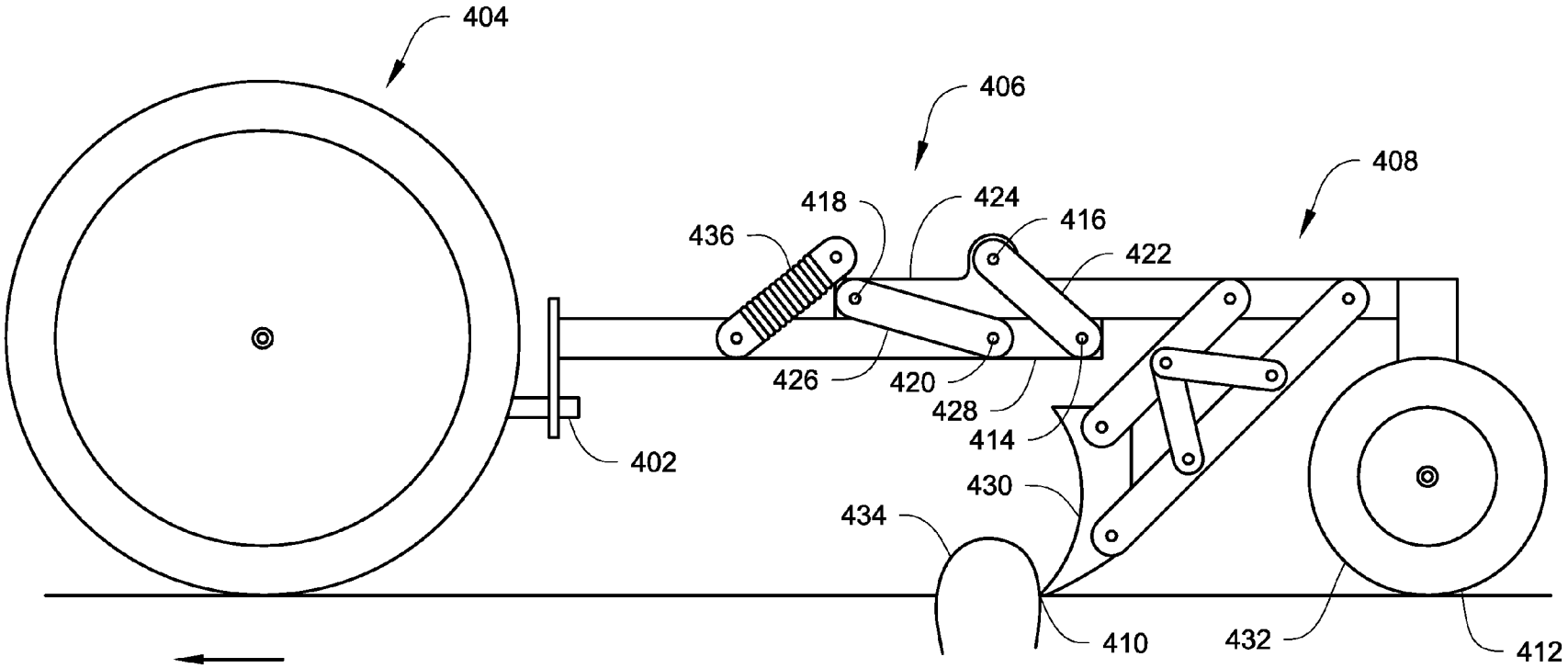
FIG. 18A is an illustration of a side view of a vehicle pulling an implement in accordance with the present invention.
Figure 18B:
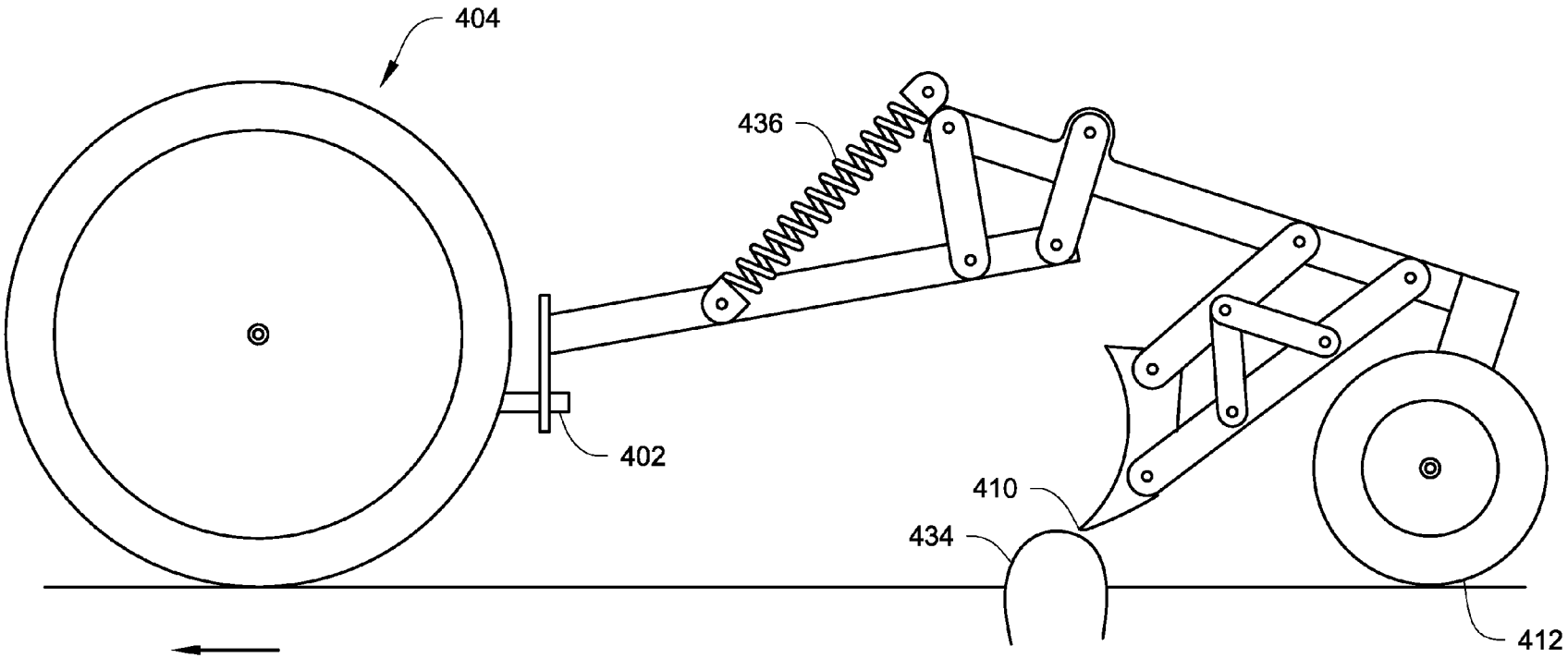
FIG. 18B is an illustration of a side view of the machine and implement of FIG. 18A when the implement has moved from the first configuration of FIG. 18A to its second configuration.

Several embodiments of implement 10 have been disclosed. The prior disclosed embodiments have shown the inventive implement to be in front of the forward motion-producing machine. In FIGS. 18A and 18B, the inventive implement is disclosed to be behind the forward motion-producing machine. Implement 400 is shown attached at hitch 402 to a wheeled vehicle 404. Linkage assembly 406 attaches between vehicle 404 and work assembly 408. Work assembly 408 has an edge 410 and a heel 412. Linkage assembly 406 has first, second, third, and fourth pivot axes 414, 416, 418, and 420, respectively. The first, second, third, and fourth inextensible members 422, 424, 426, and 428, respectively, connect the various pivot axes as described with respect to other embodiments. In the embodiment shown, inextensible member 424 further connects with work assembly 408. Edge 410 is part of a blade 430 which is braced for attachment to inextensible member 424. Heel 412 is formed by an appropriate portion of wheel 432 which is also attached to inextensible member 424.

It is understood that heel 412 need not be a wheel. Heel 412 could be formed by an array of disks which follow edge 410 or by some other structure of the inventive implement which forms a surface about which edge 410 can move when going from the inactivated state to the activated state and vice versa.

In use, when edge 410 of blade 430 contacts an immovable obstacle 434, linkage assembly 406 moves from its first configuration as shown in FIG. 18A to its second configuration as shown in FIG. 18B. Edge 410 is elevated about heel 412 as linkage 406 moves from the first to the second configuration. Spring 436 goes into extension so that when edge 410 passes over the immovable obstacle 434, spring 436 pulls linkage 406 back into its first configuration from its second configuration.

Thus, in an implement attaching to a forward motion-producing machine and having a work assembly with an edge and a heel and a linkage assembly attachable as a sole attachment between the work assembly and the forward motion-producing machine and having first and second configurations, the implement has structure and function so that in its first configuration the edge moves in a forward direction as determined by the forward motion-producing machine and moves along a path generally parallel with the path. In the second configuration of the structure, the edge is elevated above the prevailing ground surface in order to pass over an immovable obstacle encountered by the edge. In this way, the edge moves about the heel of the work assembly.

Thus, preferred embodiments of the implement in accordance with the present invention have been described in detail. It is understood, however, that equivalents to the disclosed invention are possible. Therefore, it is further understood that changes made, especially in matter of shape, size and arrangement to the full extent extended by the general meaning of the terms in which the appended claims are expressed, are within the principle of the invention.

What is claimed is:

1. An implement attaching to a forward motion-producing machine, comprising:

a work assembly having an edge and a heel;

a linkage assembly attachable as a sole attachment between said work assembly and said forward motion-producing machine and having first and second configurations, said first configuration providing said heel to contact a prevailing ground surface, and said edge to move in a forward direction as determined by said forward motion-producing machine and to move along a path generally parallel with path, said second configuration providing said heel to maintain contact with said prevailing ground surface, and said edge to be elevated above said prevailing ground surface in order to pass over an obstruction encountered by said edge as said edge moves in the forward direction, said edge moving about said heel as said linkage assembly goes from said first configuration to said second configuration.

2. The implement in accordance with claim 1, wherein the attachment of said linkage assembly is in front of said forward motion-producing machine.

3. The implement in accordance with claim 1, wherein the attachment of said linkage assembly is behind said forward motion-producing machine.

4. An implement attaching to a forward motion-producing machine, comprising:

work means for cutting or scraping, said work means having an edge and a heel;

linkage means, attachable as a sole attachment between said work means and said forward motion-producing machine and having first and second configurations, for supporting said edge in the first configuration along a path generally parallel with prevailing ground surface as said edge moves in a forward direction as determined by said forward motion-producing machine and for elevating said edge in the second configuration above said prevailing ground surface in order to pass over an obstruction encountered by said edge as said edge moves in the forward direction, said edge moving about said heel as said linkage means moves from said first configuration to said second configuration, wherein said heel maintains contact with said prevailing ground surface in said first configuration and in said second configuration.

5. An implement attaching to a forward motion-producing machine, comprising:

a work assembly having an edge and a heel; and a linkage assembly attachable between the motion-producing machine and said work assembly having first and second pivot axes pivotally connecting with said work assembly, said first pivot axis being beneath said second pivot axis, said linkage assembly having first and second configurations, said first configuration including said first axis located in a first position horizontally relative to said second axis, said second configuration including said first axis located in a second position horizontally relative to said second axis, said second position being horizontally separated in a direction toward said work assembly relative to said first position, wherein when the edge of the work assembly strikes an immovable object, the linkage assembly moves from the first to the second configuration, wherein when said linkage assembly is in said first configuration, the edge and the heel of the work assembly are both resting on ground, and wherein when said linkage assembly is in said second configuration, the heel of the work assembly is on the ground and the edge is elevated to allow the edge to ride over the immovable object.

6. The implement in accordance with claim 5, wherein the first pivot axis is located in a brace attaching to said work assembly, said brace having an end located facing the ground and so that said brace end is less than an inch from the ground when said linkage assembly is in the second configuration, said pivot axis being less than an inch from the brace end.

7. The implement in accordance with claim 5, wherein the linkage assembly further includes third and fourth pivot axes and first, second, third and fourth inextensible members, said first inextensible member connecting said first and second pivot axes, said second inextensible member connecting said second and third pivot axes, said third inextensible member connecting said third and fourth pivot axes, said fourth inextensible member connecting said fourth and first pivot axes, said second and fourth inextensible members being nonparallel so that said first pivot axis moves from said first to said second position when said first work assembly strikes the immovable object, said fourth inextensible member including a frame assembly attachable to said motion-producing machine and having a pair of downwardly projecting legs pivotally attached to said work assembly at said first pivot axis, said downwardly projecting legs each including a hinged joint, said downwardly projecting legs of said frame assembly having upper portions and lower portions separated at break locations, said lower portions comprising top and bottom lower portions slideably attached to one another, a fluid filled cylinder attached between said top and bottom lower portions for reversibly elongating said lower portion, and a control circuit for controlling said fluid filled cylinder when said edge of said work assembly strikes the immovable object.

8. The implement in accordance with claim 5, wherein the linkage assembly further includes third and fourth pivot axes and first, second, third and fourth inextensible members, said first inextensible member connecting said first and second pivot axes, said second inextensible member connecting said second and third pivot axes, said third inextensible member connecting said third and fourth pivot axes, said fourth inextensible member connecting said fourth and first pivot axes, said second and fourth inextensible members being nonparallel so that said first pivot axis moves from said first to said second position when said first work assembly strikes the immovable object, said fourth inextensible member being inclined about 70 degrees from horizontal when said linkage assembly is in the first configuration and about 90 degrees from horizontal when said linkage assembly is in the second configuration.

* * * * *